US009902542B2

(12) United States Patent
VanGordon et al.

(10) Patent No.: US 9,902,542 B2
(45) Date of Patent: Feb. 27, 2018

(54) CONTAINER APPARATUS

(71) Applicant: COLGATE-PALMOLIVE COMPANY, New York, NY (US)

(72) Inventors: Todd VanGordon, Basking Ridge, NJ (US); Thomas Heaslip, Basking Ridge, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/130,879

(22) Filed: Apr. 15, 2016

(65) Prior Publication Data

US 2017/0297797 A1 Oct. 19, 2017

(51) Int. Cl.

| | |
|---|---|
| ***B65D 75/00*** | (2006.01) |
| ***B65D 23/08*** | (2006.01) |
| ***B65D 55/08*** | (2006.01) |
| ***B65D 75/58*** | (2006.01) |

(52) U.S. Cl.

CPC ..... *B65D 75/002* (2013.01); *B65D 23/0878* (2013.01); *B65D 55/0854* (2013.01); *B65D 75/5827* (2013.01)

(58) Field of Classification Search

CPC ..... B65D 75/002; B65D 75/5827; B65D 75/5833; B65D 75/5844; B65D 55/0854; B65D 23/0878

USPC ..... 206/497; 229/87.05; 40/310

See application file for complete search history.

(56) References Cited

U.S. PATENT DOCUMENTS

| | | | | | |
|---|---|---|---|---|---|
| 2,330,878 | A | * | 10/1943 | Foley | B65D 43/0218 229/123.2 |
| 2,954,139 | A | | 9/1960 | Owens | |
| 3,189,208 | A | | 6/1965 | Jowett | |
| 3,780,856 | A | * | 12/1973 | Braverman | B65D 75/327 206/459.5 |
| 3,811,591 | A | * | 5/1974 | Novitch | B65D 55/0854 215/12.2 |
| 4,018,904 | A | * | 4/1977 | Muraoka | B65D 55/0854 206/217 |
| 4,556,152 | A | | 12/1985 | Bogren | |
| 4,758,456 | A | | 7/1988 | Muscala | |
| 5,292,018 | A | | 3/1994 | Travisano | |
| 5,375,718 | A | | 12/1994 | Honma et al. | |
| 5,495,944 | A | * | 3/1996 | Lermer | B65D 23/0842 206/459.1 |

(Continued)

*Primary Examiner* — Steven A. Reynolds

(57) ABSTRACT

A container apparatus including a container and a sleeve with pre-weakened areas to facilitate detaching the sleeve from the container. The container may include a body and a cap coupled thereto. The sleeve may include tamper evident features and may maintain the container in a closed and packaged state prior to purchase and use by a consumer. The sleeve may include different pre-weakened or perforated sections to permit the consumer to remove a first portion of the sleeve to permit the user to open the container and use the product therein without also removing a second portion of the sleeve which may contain product information. The sleeve may then include an additional pre-weakened or perforated section to permit the consumer to remove the second portion of the sleeve after the container is empty for sustainability purposes so that the container is more readily recyclable.

14 Claims, 21 Drawing Sheets

(56) References Cited

U.S. PATENT DOCUMENTS

| | | | | |
|---|---|---|---|---|
| 5,544,770 | A * | 8/1996 | Travisano | B65D 55/026 206/807 |
| 5,605,230 | A | 2/1997 | Marino, Jr. et al. | |
| 6,296,129 | B1 | 10/2001 | Kawasaki | |
| 6,385,878 | B1 | 5/2002 | Key | |
| 6,691,439 | B1 * | 2/2004 | Miyashita | B65D 23/0878 40/310 |
| 6,746,744 | B1 | 6/2004 | Ishihara et al. | |
| 7,458,458 | B2 | 12/2008 | Marco | |
| 8,003,033 | B2 | 8/2011 | Elgebranl | |
| 8,511,472 | B2 | 8/2013 | Dupuis | |
| 2012/0211526 | A1 * | 8/2012 | Dupuis | B65D 23/0878 222/206 |
| 2014/0348976 | A1 * | 11/2014 | Aranda Campin | B65D 51/20 426/2 |

* cited by examiner

CONTAINER APPARATUS

BACKGROUND

Containers and other types of packaging are known to be sold with a sleeve thereon that provides product information to the consumer. Such sleeves are often referred to as heat shrinkable films. The use of such sleeves permits the same base container to be used to contain different products because the manufacturing facility only needs to provide an appropriately labeled sleeve to the container for identification of the product contained therein. However, many states or municipalities therein are unable to recycle the container with the sleeve thereon. Thus, there remains a need to enable consumers to easily remove the sleeve from the container and to encourage consumers to facilitate the removal of the sleeve from the container prior to recycling.

BRIEF SUMMARY

The present invention may be directed, in one aspect, to a container apparatus including a container and a sleeve circumscribing at least a portion of the container. The container may include a body and a cap. The sleeve may include tamper evident features and may maintain the container in a closed and packaged state prior to purchase and use by a consumer. The sleeve may include different pre-weakened or perforated sections to permit the consumer to remove a first portion of the sleeve to permit the user to open the container and use the product therein without also removing a second portion of the sleeve which may contain product information. The sleeve may then include an additional pre-weakened or perforated section to permit the consumer to remove the second portion of the sleeve after the container is empty for sustainability purposes so that the container is more readily recyclable.

In one aspect, the invention may be a container apparatus comprising: a container extending from a bottom end to a top end along an axis, the container comprising: a body having a cavity for containing a material; and a cap coupled to the body; a sleeve circumscribing at least a portion of container, the sleeve having a first pre-weakened section that divides the sleeve into a first portion and a second portion, the first portion of the sleeve comprising a second pre-weakened section and the second portion of the sleeve comprising a third pre-weakened section; and wherein the second and third pre-weakened sections are circumferentially offset from one another.

In another aspect, the invention may be container apparatus comprising: a container extending along an axis, the container comprising: a body having a cavity for containing a material; a dispensing orifice in spatial communication with the cavity; a cap coupled to the body, the cap alterable between: (1) a first state in which the cap closes the dispensing orifice; and (2) a second state in which the dispensing orifice is open; a sleeve on the container, the sleeve comprising: a first pre-weakened section that delineates a first tear line that circumscribes the container, the first pre-weakened section dividing the sleeve into a first portion and a second portion, the first portion of the sleeve configured to prevent the cap from being altered from the first state into the second state when intact on the container, the second portion of the sleeve circumscribing at least a portion of the body; the first portion of the sleeve comprising a second pre-weakened section that delineates a second tear line that intersects the first tear line at a first point; the second portion of the sleeve comprising a third pre-weakened section that delineates a third tear line that intersects the first tear line at a second point, the first and second points being circumferentially offset from one another In yet another aspect, the invention may be a blank for a container sleeve comprising: a sheet of material extending from a bottom edge to a top edge along an axis, the sheet of material having first and second side edges extending between the bottom and top edges; a first pre-weakened section extending between the first and second side edges of the sheet of material; a second pre-weakened section extending between the top edge of the sheet of material and the first pre-weakened section; a third pre-weakened section extending between the bottom edge of the sheet of material and the first pre-weakened section; and wherein the second and third pre-weakened sections are transversely spaced apart from one another.

In still another aspect, the invention may be a container apparatus comprising: a container extending from a bottom end to a top end along an axis, the container comprising: a body having a cavity for containing a material; and a cap coupled to the body; a sleeve circumscribing at least a portion of the container and extending from a bottom edge to a top edge, the sleeve having a first pre-weakened section that divides the sleeve into a first portion and a second portion, the first portion of the sleeve comprising a second pre-weakened section and the second portion of the sleeve comprising a third pre-weakened section; wherein the third pre-weakened section comprises an alternating arrangement of perforated segments and non-perforated segments, the non-perforated segments having a maximum length; and wherein the third pre-weakened section extends from the bottom edge of the sleeve to a location that is spaced an axial distance from the first pre-weakened section of the sleeve, the axial distance being greater than the maximum length.

In a further aspect, the invention may be a container apparatus comprising: a container extending from a bottom end to a top end along an axis, the container comprising: a body having a cavity for containing a material; and a cap coupled to the body; a sleeve circumscribing at least a portion of the container, the sleeve having a first pre-weakened section that divides the sleeve into a first portion and a second portion, the first portion comprising a second pre-weakened section and the second portion comprising a third pre-weakened section; and wherein the first pre-weakened section has a first tear strength, the second pre-weakened section has a second tear strength, and the third pre-weakened section has a third tear strength, the third tear strength being greater than the first tear strength.

In a still further aspect, the invention may be a container apparatus comprising: a container extending from a bottom end to a top end along an axis, the container comprising: a body having a cavity for containing a material; and a cap coupled to the body; a sleeve circumscribing at least a portion of the container, the sleeve having a first pre-weakened section that divides the sleeve into a first portion and a second portion, the first portion comprising a second pre-weakened section and the second portion comprising a third pre-weakened section; and wherein the first pre-weakened section has a first tear strength, the second pre-weakened section has a second tear strength, and the third pre-weakened section has a third tear strength, one of the first, second, and third tear strengths being different than at least one of the other of the first, second, and third tear strengths.

In another aspect, the invention may be a container apparatus comprising: a container extending from a bottom end to a top end along an axis, the container comprising: a body having a cavity for containing a material; and a cap coupled to the body; a sleeve extending from a bottom edge to a top edge and circumscribing at least a portion of the container, the sleeve having a first pre-weakened section that divides the sleeve into a first portion and a second portion, the first portion comprising a second pre-weakened section extending from the top edge of the sleeve towards the first pre-weakened section and the second portion comprising a third pre-weakened section extending from the bottom edge of the sleeve towards the first pre-weakened section; wherein the second pre-weakened section comprises a first pair of spaced apart pre-weakened lines and a first removable strip between the first pair of spaced apart pre-weakened lines, the first removable strip comprising a first tear initiation indicia; and wherein the third pre-weakened section comprises a second pair of spaced apart pre-weakened lines and a second removable strip between the second pair of spaced apart pre-weakened lines, the second removable strip comprising a second tear initiation indicia located adjacent to the bottom end of the container.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1A:
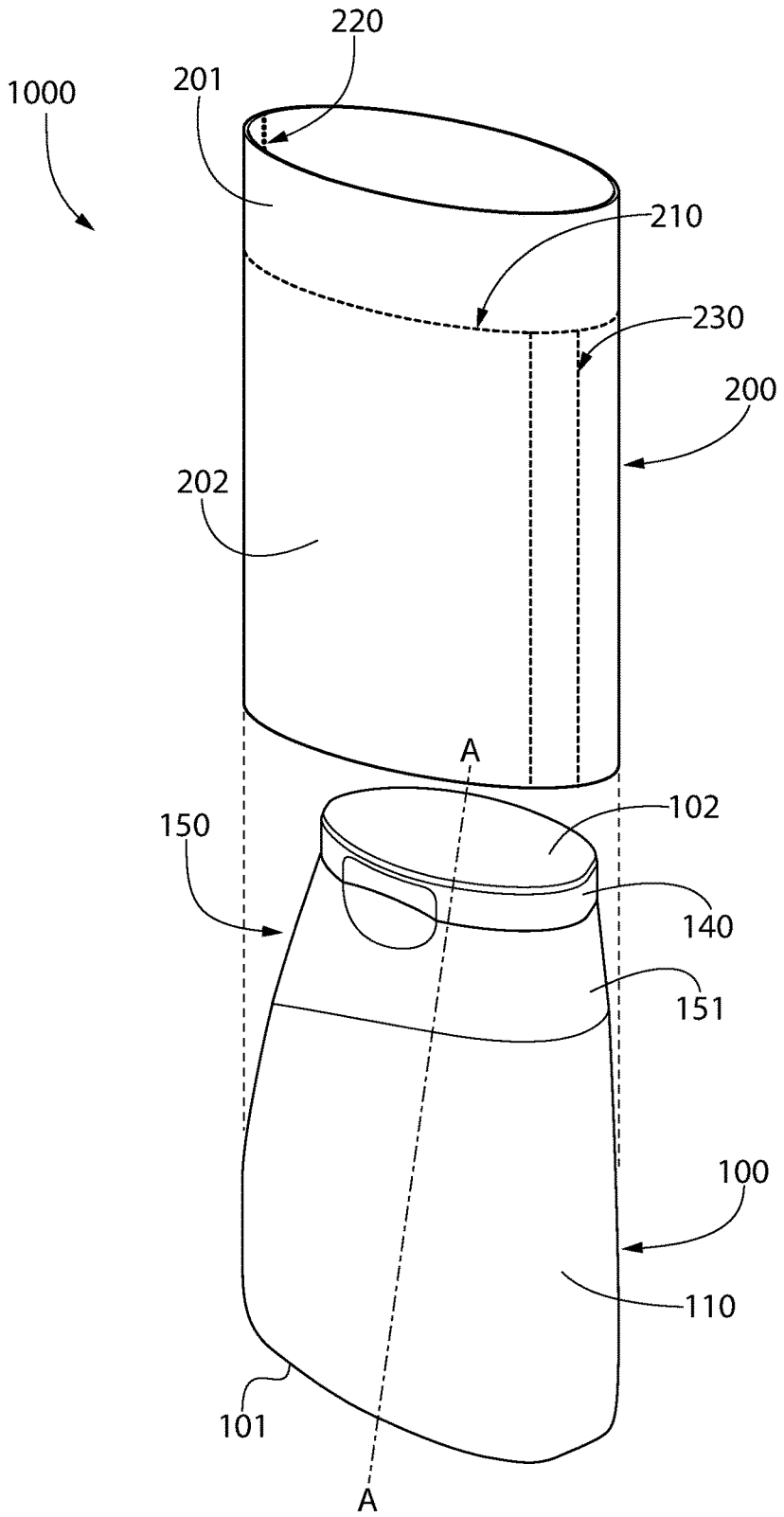
FIG. 1A is a perspective view of a container apparatus illustrating a container and a sleeve in an exploded state.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1B:
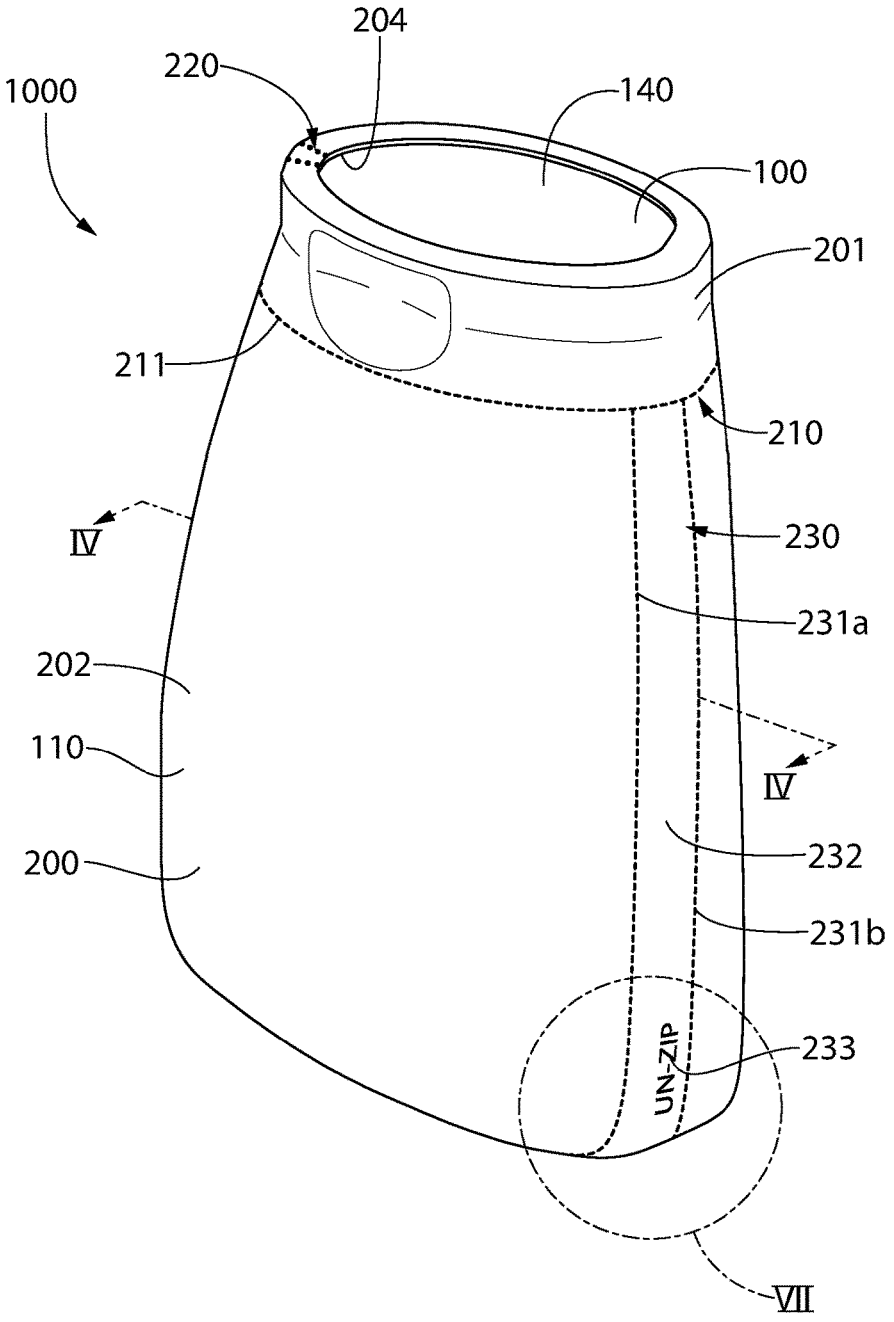
FIG. 1B is front perspective view of the container apparatus of FIG. 1A with the sleeve circumscribing at least a portion of the container.
Figure 2:
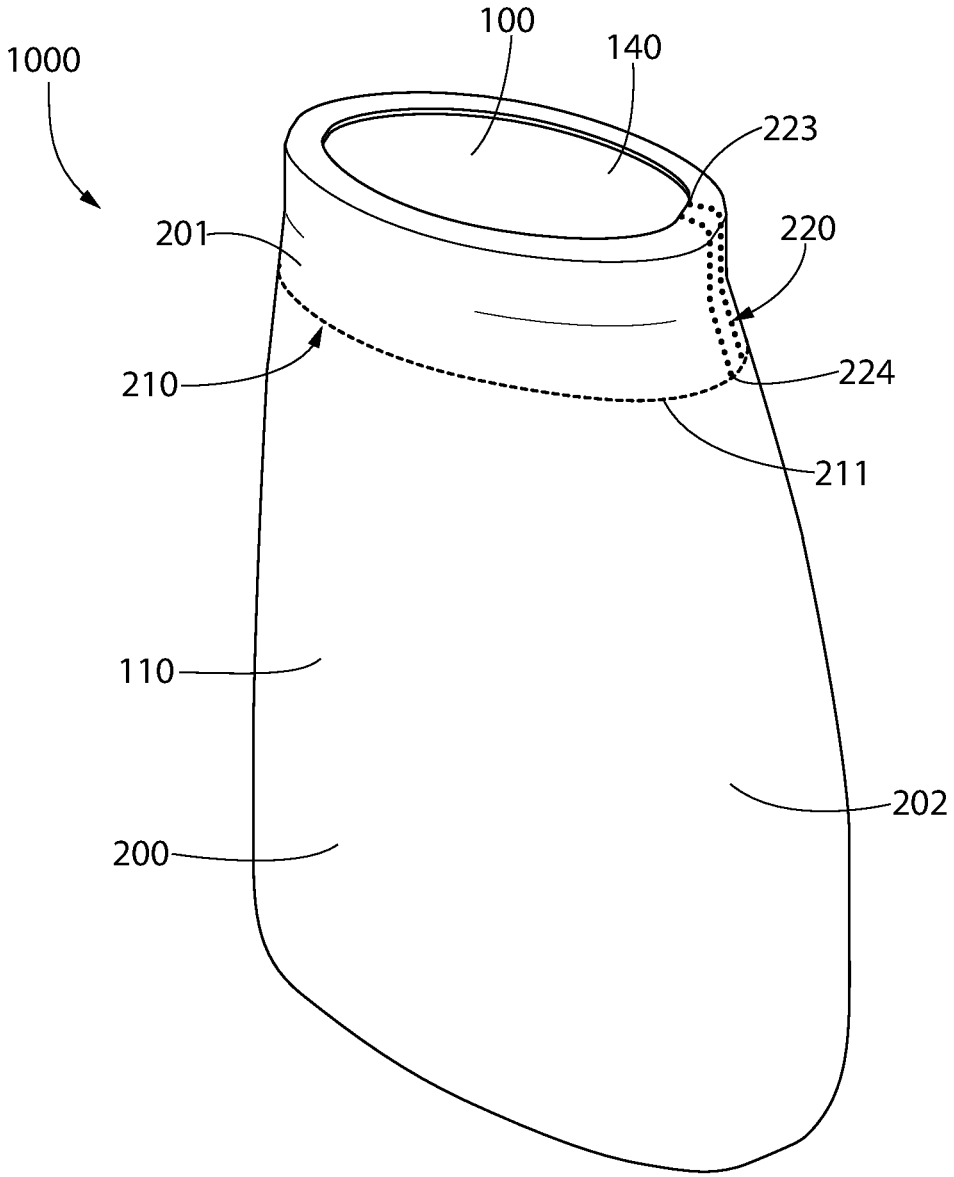
FIG. 2 is a rear perspective view of the container apparatus of FIG. 1B.
Figure 3:
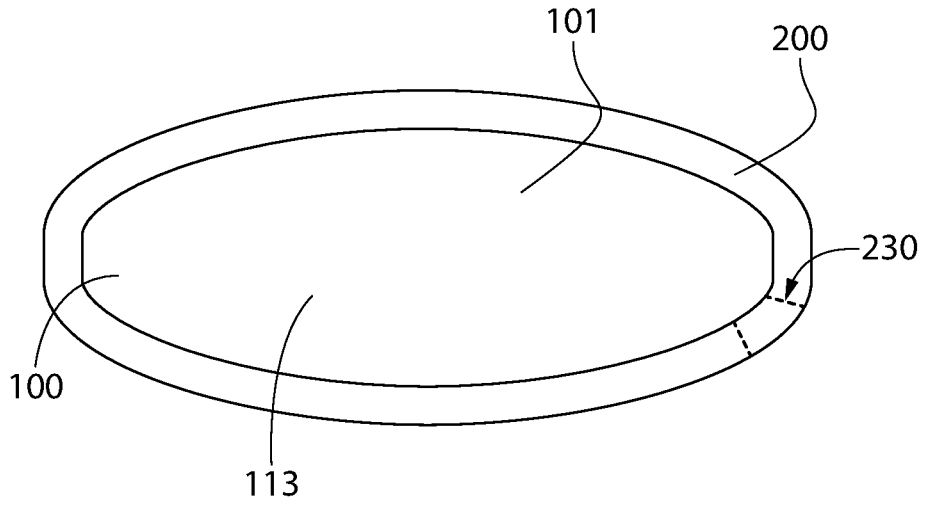
FIG. 3 is a bottom view of the container apparatus of FIG. 1B.
Figure 4:
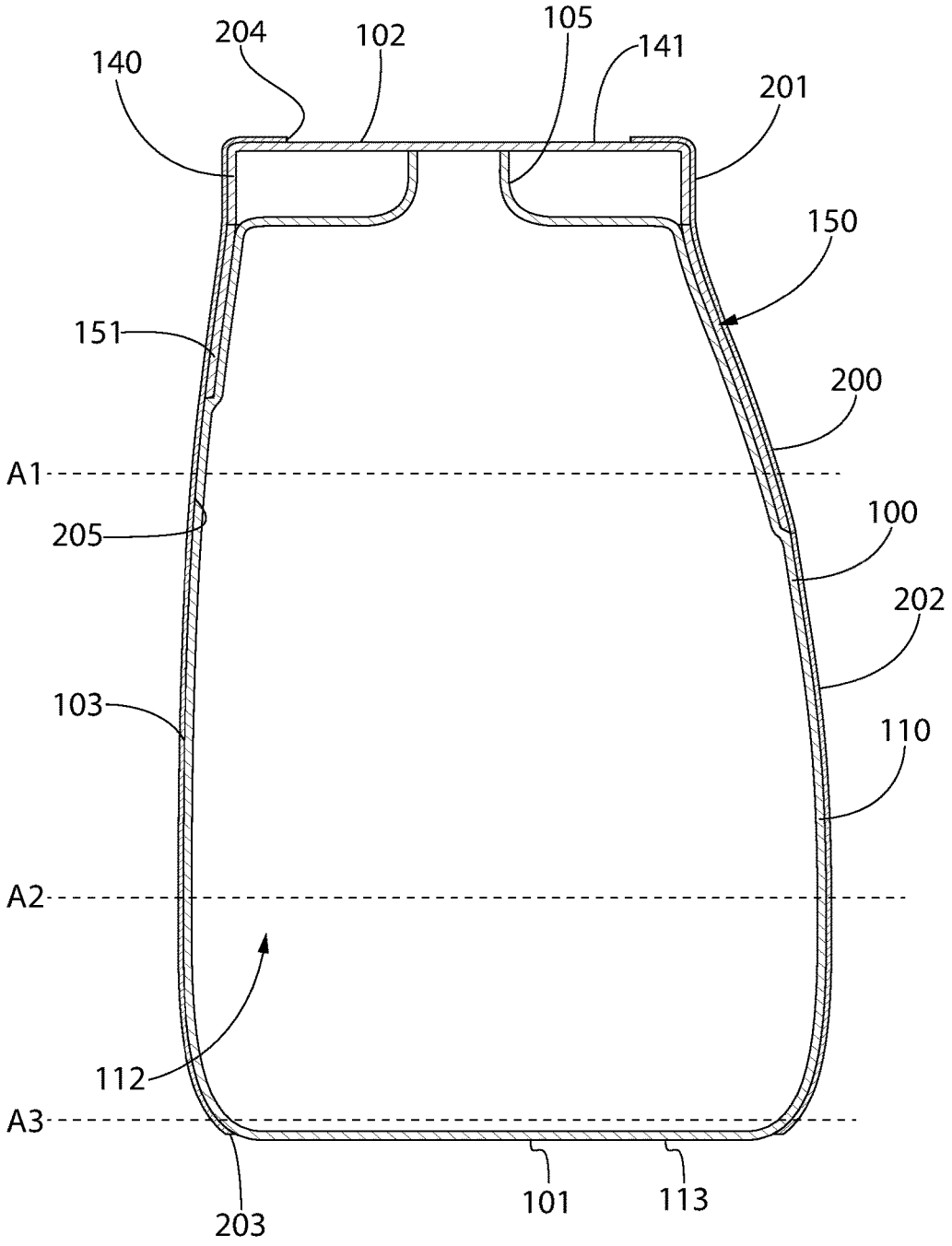
FIG. 4 is a cross-sectional view taken along line IV-IV of FIG. 1B.

Referring first to FIGS. 1A, 1B, and 4 concurrently, a container apparatus 1000 comprising a container 100 and a sleeve 200 will be described. The container 100 extends from a bottom end 101 to a top end 102 along an axis A-A. Furthermore, the container 100 generally comprises a body 110 and a cap 140 coupled to the body 110. A bottom surface 113 of the body 110 forms the bottom end 101 of the container 100 and a top surface 141 of the cap 140 forms the top end 102 of the container 100. In the exemplified embodiment, the cap 140 is formed as a part of a lid assembly 150 that comprises the cap 140 and a skirt portion 151. The skirt portion 15 of the lid assembly 150 is coupled to the body 110 of the container 100 and the cap 140 is coupled to the skirt portion 151 to as to be capable of being alternated between a closed state and an open state, as illustrated and described in greater detail below with reference to FIGS. 10A and 10B. The positioning of the lid assembly 150 relative to the body 110 of the container 100 is best illustrated in FIG. 4.

The body 110 comprises an inner surface 111 that defines a cavity 112 for containing the material. Furthermore, the container 100 comprises a dispensing orifice 105 in spatial communication with the cavity 112 to provide a passageway for the material stored within the cavity 112 to be dispensed from the cavity 112 for use by a consumer. The material contained or stored within the cavity 112 of the body 110 of the container 100 may be flowable such as a dentifrice, oral care fluid, shampoo, conditioner, soap, or the like or it may be solid or semi-solid such as a deodorant or the like. The viscosity of the material may vary depending on its application and use. The cap 140 may be alterable between a first state (i.e., a closed state as illustrated in FIGS. 1A, 1B and 4) that closes the dispensing orifice 105 and prevents the material from being dispensed from the cavity 112 and a second state (i.e., an open state as illustrated in FIG. 10B) that permits the material in the cavity 112 to be dispensed via the dispensing orifice 105.

The body 110 of the container 100 is preferably made of a non-porous material so that the body 110 of the container 100 is configured to contain a material such as those described above without the material leaching out prior to its being purposefully dispensed by a consumer or end user. Specifically, the body 110 of the container 100 is preferably formed of a plastic material. The material that forms the body 110 of the container 100 may be a rigid material having a sufficiently thin wall thickness to permit the body 110 to be squeezed to dispense the material therefrom. Of course, the exact material and rigidity of the body 110 of the container 100 is not to be limiting of the invention in all embodiments. Thus, in other embodiments the body 110 of the container 100 may be rigid and not capable of being squeezed, and in such embodiments an actuation mechanism may be included to facilitate dispensing of the material from the container 100 via the dispensing orifice 105. The container 100 may include indicia or other product information thereon, or it may be devoid of such information, which may instead (or additional) be provided on the sleeve 200.

Although a specific shape is provided for the container 100 in the exemplified embodiment, the invention is not to be limited by the shape of the container 100 in all embodiments and any shape is possible in various other embodiments. Furthermore, in certain instances the sleeve 200 is described as circumscribing the container 100. This is not intended to limit the container 100 to any particular shape, such as one which has a circular cross-section. Rather, the container 100 may have any cross-sectional shape, and the term circumscribe as used herein merely means that the sleeve 200 is wrapped around the container 100 or portions thereof.

The sleeve 200 may function as both a label for the container 100 by having product information and other indicia provided on the sleeve 200 and a tamper-evident feature configured to maintain the container 100 in a closed state prior to purchase and use by a consumer and to inform the consumer (or other person such as a retail store employee) when the container apparatus 1000 has been tampered or interfered with prior to purchase. The sleeve 200 may be formed of a material known for its use as a heat shrink film, such as a polymer plastic film including those made of polyvinyl chloride, polyolefin, polyethylene, polypropylene, or the like. Furthermore, the sleeve 200 may have distinct pre-weakened sections including a first pre-weakened section 210 and a second pre-weakened section 230 that collectively permit a first portion 201 of the sleeve 200 to be detached from a second portion 202 of the sleeve 200 and separated from the container 100 and a third pre-weakened section 230 that permits the second portion 202 of the sleeve 200 to be separated from the container 100. In certain embodiments, the first portion 201 of the sleeve 200 may be an upper portion of the sleeve 200 and the second portion 202 of the sleeve 200 may be a lower portion of the sleeve 200.

FIG. 1A illustrates the container apparatus 1000 with the sleeve 200 separate from the container 100 prior to the sleeve 200 being coupled to or otherwise positioned on or wrapped around the container 100. In certain embodiments, the sleeve 200 may be a shrink wrap sleeve such that the sleeve 200 is positioned on the container 100 and then heat (via an electric or gas heat gun or a heat tunnel on a conveyor or the like) is applied to the sleeve, thereby causing the sleeve 200 to shrink to be tightly wrapped onto the container 100. Specifically, the sleeve 200 in its non-shrunk state is larger than the outer surface of the container 100. The sleeve 200 is wrapped around the container 100 and then heat is applied to the sleeve 200, which causes the sleeve 200 to shrink until the sleeve 200 is snugly wrapped around the container 100. Techniques for coupling a shrink wrap sleeve to a container are well known in the art. Of course, the invention is not limited to shrink wrap sleeves and the sleeve 200 may be coupled to the container 100 using other techniques in other embodiments.

Referring to FIGS. 1B-4, various views are provided illustrating the sleeve 200 positioned on the container 100. Specifically, the sleeve 200 is positioned on the container 100 (via shrink wrap techniques or otherwise) so as to circumscribe at least a portion of the container 100 (as noted above, the term "circumscribe" is not in any way limiting of the shape or cross-sectional shape of the container 100). The sleeve 200 extends from a bottom edge 203 to a top edge 204. In the exemplified embodiment, the bottom edge 203 of the sleeve 200 is located at or adjacent to the bottom end 101 of the container 100 formed by a bottom surface 113 of the body 110 and the top edge 204 of the sleeve is located at the top end 102 of the container 100 formed by a top surface 141 of the cap 140. Thus, in the exemplified embodiment the sleeve 200 circumscribes the container 100 along its entire height between the bottom and top ends 101, 102 thereof. Furthermore, in the exemplified embodiment a portion of the sleeve 200 extends onto and covers a portion of the top surface 141 of the cap 140, which enhances the tamper-evident functionality of the sleeve 200 by preventing the cap 140 from opening while the sleeve 200 is positioned on the container 100. However, the invention is not to be so limited in all embodiments and the sleeve 200 need not circumscribe the container 100 along its entire length in all embodiments. However, it is generally preferred that the sleeve 200 circumscribe at least a portion of the body 110 of the container 100 and a portion of the cap 140 of the container 100 so that the sleeve 200 may function as a tamper-evident structure as described above. Specifically, so long as the sleeve 200 circumscribes a portion of the cap 140, a consumer or retail employee can determine whether the cap has been opened prior to purchase because tampering would be evident on the sleeve 200 which would need to be torn to permit opening of the cap 140.

As noted above, the sleeve 200 comprises a first pre-weakened section 210 that divides the sleeve into the first portion (or upper portion) 201 and the second portion (or lower portion) 202. The first portion 201 of the sleeve 200 is the portion of the sleeve 200 located between the first pre-weakened section 210 and the top edge 204 of the sleeve 200 and the second portion 202 of the sleeve 200 is the portion of the sleeve 200 located between the first pre-weakened section 210 and the bottom edge 203 of the sleeve 200. The first portion 201 of the sleeve 200 is configured to prevent the cap 140 from being altered from the first state (closed) to the second state (open) when the first portion 201 of the sleeve 200 remains intact on the container 100. In that regard, in the exemplified embodiment the first portion 201 of the sleeve 200 circumscribes at least a portion of the cap 140, and more specifically extends to overlay atop of a portion of the top surface 141 of the cap 140. This prevents the cap 150 from being opened while the first portion 201 of the sleeve 200 is intact on the container 200. The second portion 202 of the sleeve 200 circumscribes at least a portion of the body 110 of the container 100. In the exemplified embodiment, the second portion 202 of the sleeve 202 extends all the way to the bottom surface 113 of the body 110, but this is not required in all embodiments and the bottom edge 203 of the sleeve 200 may terminate at any location along the length of the body 110 of the container 100 in other embodiments.

When the sleeve 200 is positioned on the container 100, an inner surface 205 of the sleeve 200 is adjacent to and possibly in surface contact with an outer surface 103 of the container 100. The sleeve 200 is preferably shrunk-fit onto the container 100 to form a tight fit between the sleeve 200 and the container 100 to prevent the sleeve 200 from being separated from the container 100 until actively pursued by the consumer as discussed in more detail below. As discussed in greater detail below, in order to permit a user to dispense the material contents from the container, the user tears away the first portion 201 of the sleeve 200 while leaving the second portion 202 of the sleeve 200 intact on the container 100. The second portion 202 of the sleeve 200 may include important product information or the like rendering it desirable to leave the second portion 202 of the sleeve 200 on the container 100 until the container 100 is empty.

Thus, in certain embodiments the second portion 202 of the sleeve 200 cannot be slid off of the container 100 without tearing the sleeve 200 along the third pre-weakened section 230. This prevention of removal of the second portion 202 of the sleeve 200 without tearing along the third pre-weakened section 230 of the sleeve 200 is achieved in the exemplified embodiment by forming the portion of the body 110 of the container 100 that is circumscribed by the second portion 202 of the sleeve 200 with a first traverse cross-sectional area A1 at a first axial position, a second traverse cross-sectional area A2 at a second axial position, and a third traverse cross-sectional area A3 at a third axial position, the second axial position being located between the first and third axial positions. Furthermore, the second traverse cross-sectional area A2 is greater than each of the first and third traverse cross-sectional areas A1, A3. Having a greater cross-sectional area in between two lesser cross-sectional area sections of the container 100 prevents the second portion 202 sleeve 200 from being axially slid off of the container 100 prematurely even after the first portion 201 of the sleeve 200 has been removed from the container 100.

Referring to FIGS. 1B, 2, 5, and 6 concurrently, the container apparatus 1000, and more specifically the details of the sleeve 200, will be further described. As noted above, the sleeve 200 comprises first, second, and third pre-weakened sections 210, 220, 230 that facilitate detaching portions of the sleeve 200 from each other and separating them from the container 100 as described in more detail below. In the exemplified embodiment, each of the first, second, and third pre-weakened sections 210, 220, 230 comprise perforations or regions of the sleeve 200 that include an alternating arrangement of perforated segments and non-perforated segments. These pre-weakened sections 210, 220, 230 facilitate tearing of the sleeve 200 at the pre-weakened sections 210, 220, 230. Although illustrated herein as being perforations, the pre-weakened sections 210, 220, 230 may be other structural features that permit and in fact make it easier to tear of the sleeve 200 at the first, second, and third pre-weekend sections 210, 220, 230 as described herein below.

In the exemplified embodiment, the first pre-weakened section 210 of the sleeve 200 circumscribes the container 100 around an entire circumference of the container 100. The term circumference is not intended to be limiting of the shape of the container 100, but rather is merely intended to refer to the outer periphery of the container 100 irrespective of its shape. Thus, the container 100 may have a cross-sectional shape that is circular, or one which is polygonal such as square, rectangular, triangular, or the like. Stating that the sleeve 200 circumscribes the container 100 around an entire circumference thereof merely means that the sleeve 200 is wrapped around the outer periphery of the container 100 without any limit to the cross-sectional shape of the container 100. The invention is not to be so limited in all embodiments and the first pre-weakened section 210 may not extend about the entire circumference of the container 100 in other embodiments. In the exemplified embodiment, the first pre-weakened section 210 of the sleeve 200 extends horizontally or transverse to the axis A-A of the container 100. Specifically, in the exemplified embodiment the first pre-weakened section 210 comprises a pre-weakened line 211 that extends substantially horizontally or transverse to the axis A-A. Although illustrated herein as a single pre-weakened line 211, the invention is not to be so limited in all embodiments and the first pre-weakened section 210 may comprise two (i.e., a pair) or more pre-weakened lines in other embodiments as described herein. Furthermore, it should be appreciated that the first pre-weakened section 210 need not be exactly transverse to the axis A-A in all embodiments and it may intersect the axis A-A at an oblique angle in some embodiments. Thus, the first pre-weakened section 210 may extend diagonally, in a curved, wavy, or sinusoidal manner, or the like. It is merely preferable that the first pre-weakened section 210 extend about most or an entirety of the circumference of the body 110 of the container 100 to divide the sleeve 200 into the first and second portions (i.e., upper and lower portions) 201, 202 as described herein. Furthermore, in the exemplified embodiment the first pre-weakened section 210 extends along or delineates a first tear line TL1. The first tear line TL1 is a reference line that is coextensive along the first pre-weakened section 210. The first tear line TL1 is not necessarily a pre-weakened line in the sleeve, but rather is a reference line delineated by the first pre-weakened section 210.

In the exemplified embodiment, the second pre-weakened section 220 of the sleeve 200 is located entirely in the first portion 201 of the sleeve 200 between the first pre-weakened section 210 and the top edge 204 of the sleeve 200. More specifically, in the exemplified embodiment the second pre-weakened section 220 of the sleeve 200 extends from the top edge 204 of the sleeve 200 to the first pre-weakened section 200 of the sleeve 200. In this embodiment, the second pre-weakened section 220 does not extend onto the second portion 201 of the sleeve 200 and thus does not extend beyond the first pre-weakened section 210 of the sleeve. However, the invention is not to be so limited in all embodiments and the second pre-weakened section 220 of the sleeve 200 may be located between the top edge 204 of the sleeve 200 and the first pre-weakened section 210 of the sleeve 200 without extending all the way to one or both of the top edge 204 and the first pre-weakened section 200. Thus, the second pre-weakened section 220 may be spaced from one or both of the top edge 204 and the first pre-weakened section 200 in some embodiments.

Figure 6:
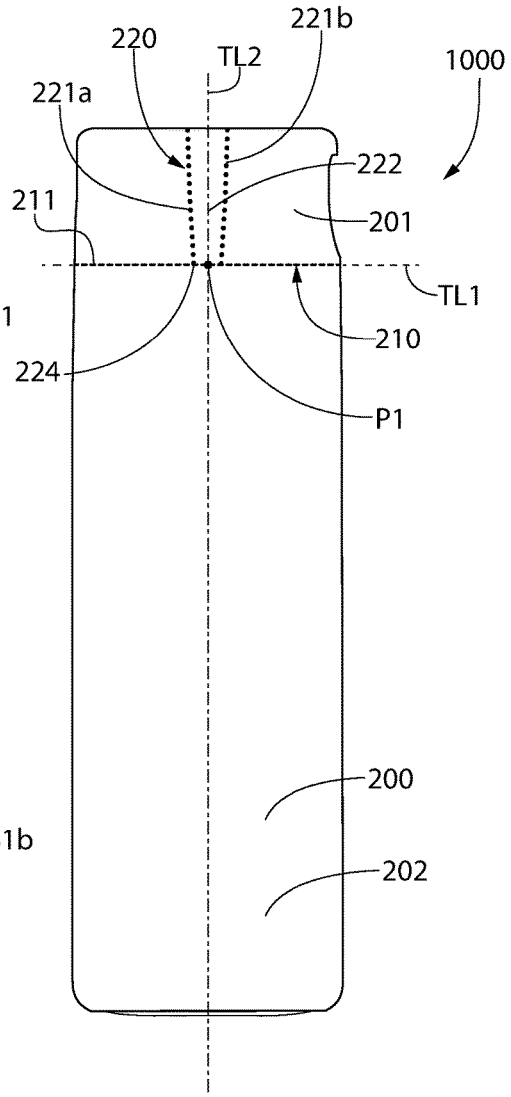
FIG. 6 is a left-side view of the container apparatus of FIG. 1B.

In the exemplified embodiment, the second pre-weakened section 220 extends substantially vertically in the direction of the axis A-A of the container 200 such that the second pre-weakened section 220 extends in a manner that is substantially perpendicular to the first pre-weakened section 210. However, the invention is not to be so limited in all embodiments and the second pre-weakened section 220 may extend in an oblique manner relative to the first pre-weakened section 210 in some embodiments. Thus, rather than extending directly in an upward-downward direction as shown in FIG. 6, the second pre-weakened section 220 may also extend diagonally. Furthermore, the second pre-weakened section 220 may extend in a curved, wavy, or sinusoidal manner or the like in other embodiments. Regardless of the exact path that the second pre-weakened section 220 takes, it is merely desirable that it extends most or the entirety of the distance between the top edge 204 of the sleeve 200 and the first pre-weakened section 210. Thus, the illustration of the second pre-weekend section 220 is exemplary in nature and is not intended to be limiting of the present invention in all embodiments.

In the exemplified embodiment, the second pre-weakened section 220 comprises a first pair of pre-weakened lines 221*a*, 221*b* and a first removable strip 222 located between the first pair of pre-weakened lines 221*a*, 221*b*. However, in other embodiments the second pre-weakened section 220 may comprise just a single pre-weakened line rather than the pair of pre-weakened lines 221*a*, 221*b*. In the exemplified embodiment, the pair of pre-weakened lines 221*a*, 221*b* are oriented so as to diverge with distance from the first pre-weakened section 210 towards the top edge 204 of the sleeve 200 and the top end 102 of the container 100. Thus, the two pre-weakened lines 221*a*, 221*b* are spaced further apart from one another the closer they are to the top edge 204 of the sleeve 200. Of course, in other embodiments the two pre-weakened lines 221*a*, 221*b* may be oriented parallel to one another or in other configurations.

The second pre-weakened section 220 extends from a first end 223 that is located at or adjacent to the top edge 204 of the sleeve to a second end 224 that is located at or adjacent to the first pre-weakened section 220. The second pre-weakened section 220 extends along or delineates a second tear line TL2. The second tear line TL2 is a reference line that is coextensive along the second pre-weakened section 220. The second tear line TL2 is not necessarily a pre-weakened line in the sleeve, but rather is a reference line delineated by the second pre-weakened section 220 (or, thought of another way, it is the axis of the second pre-weakened section 220 extending between the first and second ends 223, 224 thereof). The second tear line TL2 may extend beyond the second pre-weakened section 220 as a natural extension thereof (like an axis as noted above). Thus, even if the second pre-weakened section 220 does not intersect and is spaced from the first pre-weakened section 210, the second tear line TL2 will intersect the first pre-weakened section 210 and the first tear line TL1. In the exemplified embodiment, the second tear line TL2 intersects the first tear line TL1 at a first point P1.

In the exemplified embodiment, the third pre-weakened section 230 of the sleeve 200 is located entirely in the second portion 202 of the sleeve 200 between the first pre-weakened section 210 and the bottom edge 203 of the sleeve 200. More specifically, in the exemplified embodiment the third pre-weakened section 230 of the sleeve 200 extends from the bottom edge 203 of the sleeve 200 to the first pre-weakened section 200 of the sleeve 200. Thus, in this embodiment no portion of the third pre-weakened section 230 extends onto the first portion 201 of the sleeve 200. However, the invention is not to be so limited in all embodiments and the third pre-weakened section 230 of the sleeve 200 may be located between the bottom edge 203 of the sleeve 200 and the first pre-weakened section 210 of the sleeve 200 without extending all the way to one or both of the bottom edge 203 and the first pre-weakened section 200. Thus, the third pre-weakened section 230 may be spaced from one or both of the bottom edge 203 and the first pre-weakened section 200 in some embodiments.

Figure 5:
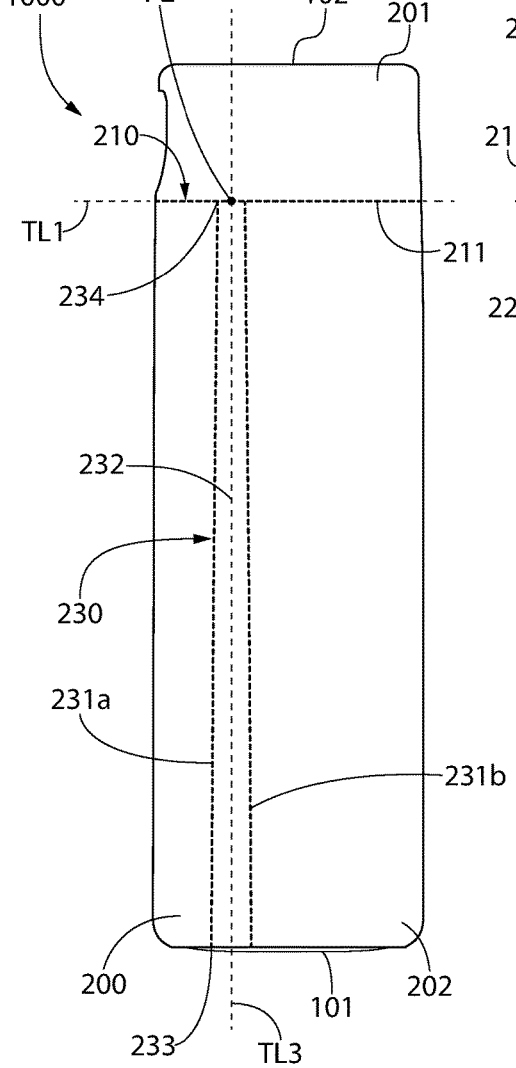
FIG. 5 is a right-side view of the container apparatus of FIG. 1B.

In the exemplified embodiment, the third pre-weakened section 230 extends substantially vertically in the direction of the axis A-A of the container 200 such that the third pre-weakened section 230 extends in a manner that is substantially perpendicular to the first pre-weakened section 210. However, the invention is not to be so limited in all embodiments and the third pre-weakened section 230 may extend in an oblique manner relative to the first pre-weakened section 210 in some embodiments. Thus, rather than extending directly in an upward-downward direction as shown in FIG. 5, the third pre-weakened section 230 may also extend diagonally. Furthermore, the third pre-weakened section 230 may extend in a curved, wavy, or sinusoidal manner or the like in other embodiments. Regardless of the exact path that the third pre-weakened section 230 takes, it is merely desirable that it extends most or the entirety of the distance between the bottom edge 203 of the sleeve 200 and the first pre-weakened section 210. Thus, the illustration of the third pre-weekend section 230 is exemplary in nature and is not intended to be limiting of the present invention in all embodiments.

In the exemplified embodiment, the third pre-weakened section 230 comprises a second pair of pre-weakened lines 231*a*, 231*b* and a second removable strip 232 located between the second pair of pre-weakened lines 231*a*, 231*b*. However, in other embodiments the third pre-weakened section 230 may comprise just a single pre-weakened line rather than the pair of pre-weakened lines 231*a*, 231*b*. In the exemplified embodiment, the pair of pre-weakened lines 231*a*, 231*b* are oriented so as to diverge with distance from the first pre-weakened section 210 towards the bottom edge 203 of the sleeve 200 and the bottom end 101 of the container 100. Thus, the two pre-weakened lines 231*a*, 231*b* are spaced further apart from one another the closer they are to the bottom edge 203 of the sleeve 200. Of course, in other embodiments the two pre-weakened lines 231*a*, 231*b* may be oriented parallel to one another or in other configurations.

The third pre-weakened section 230 extends from a first end 233 that is located at or adjacent to the bottom edge 203 of the sleeve to a second end 234 that is located at or adjacent to the first pre-weakened section 220. The third pre-weakened section 230 extends along or delineates a third tear line TL3. The third tear line TL3 is a reference line that is coextensive along the third pre-weakened section 230 (and may also be thought of as an axis of the third pre-weakened section 230 extending between the first and second ends 233, 234 of the third pre-weakened section 230). The third tear line TL3 is not necessarily a pre-weakened line in the sleeve, but rather is a reference line delineated by the third pre-weakened section 230. The third tear line TL3 may extend beyond the third pre-weakened section 230 as a natural extension thereof (like an axis of a body). Thus, even if the third pre-weakened section 230 does not intersect and is spaced from the first pre-weakened section 210, the third tear line TL3 will intersect the first pre-weakened section 210 and the first tear line TL1. In the exemplified embodiment, the third tear line TL3 intersects the first tear line TL1 at a second point P2.

The second and the third pre-weakened sections 220, 230 are circumferentially offset from one another. In the exemplified embodiment, this is achieved due to the second pre-weakened section 220 being positioned along one side surface of the container 100 and the third pre-weakened section 230 being positioned along an opposite side surface of the container 100. Specifically, the container 100 has a front surface, a rear surface opposite the front surface, a first side surface, and a second side surface opposite the first side surface. The front and rear surfaces have widths measured transverse to the axis A-A that are greater than widths of the first and second side surfaces. The second and third pre-weakened sections 220, 230 are located along the opposing side surfaces in the exemplified embodiment, but may be circumferentially offset and positioned at locations that differ from that which is depicted in the drawings in other embodiments. However, the invention is not limited to the configuration illustrated in the drawings in all embodiments. Thus, other relative positions of the second and third pre-weakened sections 220, 230 are possible while still maintaining the second and third pre-weakened sections 220, 230 in positions that are circumferentially offset from one another.

In the exemplified embodiment, the second end 224 of the second pre-weakened section 220 is circumferentially offset from the second end 234 of the third pre-weakened section 230. Stated another way, in the exemplified embodiment the first point P1 at which the second tear line TL2 of the second pre-weakened section 220 intersects the first tear line TL1 of the first pre-weakened section 210 is circumferentially offset from the second point P2 at which the third tear line TL3 of the third pre-weakened section 230 intersects the first tear line TL1 of the first pre-weakened section 210. In the exemplified embodiment, the second and third pre-weakened sections 220, 230 are entirely circumferentially offset from one another such that no axis parallel to the axis A-A of the container 100 intersects both the second and third pre-weakened sections 220, 230. Of course, alternative arrangements are possible and in some embodiments it is merely desirable that the second ends 224, 234, or stated another way the first and second points P1, P2, are circumferentially offset as described herein regardless of the positioning of the remainder of the second and third pre-weakened sections 220, 230.

By circumferentially offsetting the first and second points P1, P2, the first and second portions 201, 202 of the sleeve 200 may be detached from one another and separately separated from the container 100 without the risk of accidentally detaching the entirety of the sleeve 200 from the container 100. Specifically, it may first be desirable to remove the first portion 201 of the sleeve 200 from the container 100 while leaving the second portion 202 of the sleeve 200 intact on the container 100. This may be desirable because removal of the first portion 201 of the sleeve 200 may permit use of the material stored in the container 100 while the second portion 202 of the sleeve 200 may include product information. Thus, a user will want to remove the first portion 201 of the sleeve 200 to gain access to the material contained in the container 100 while leaving the second portion 202 of the sleeve 200 intact on the container 100 so that the product information is visible. Then, after depletion of the material from the container 100, it may be desirable to remove the second portion 202 of the sleeve 200 from the container 200. This may be desirable in certain instances to ensure that the container 100 is properly recycled. Specifically, the container 100 with the sleeve 200 (or portions thereof) thereon may not be recyclable in certain municipalities. Thus, it may be desirable to provide a user an option to completely remove the sleeve 200 from the container 100 prior to recycling, which is accomplished with the invention disclosed herein.

The offset noted above assists in achieving this goal. Specifically, when a user tears along the second pre-weakened section 220 to remove the first portion 201 of the sleeve 200 from the container 200, the second portion 202 of the sleeve 200 is not also removed because the offset nature of the third pre-weakened section 230 relative to the second pre-weakened section 220 ensure that the user does not continue to tear along the third pre-weakened section 230 after tearing along the second pre-weakened section 220. This is described in detail below with reference to FIGS. 8-13.

Figure 7:
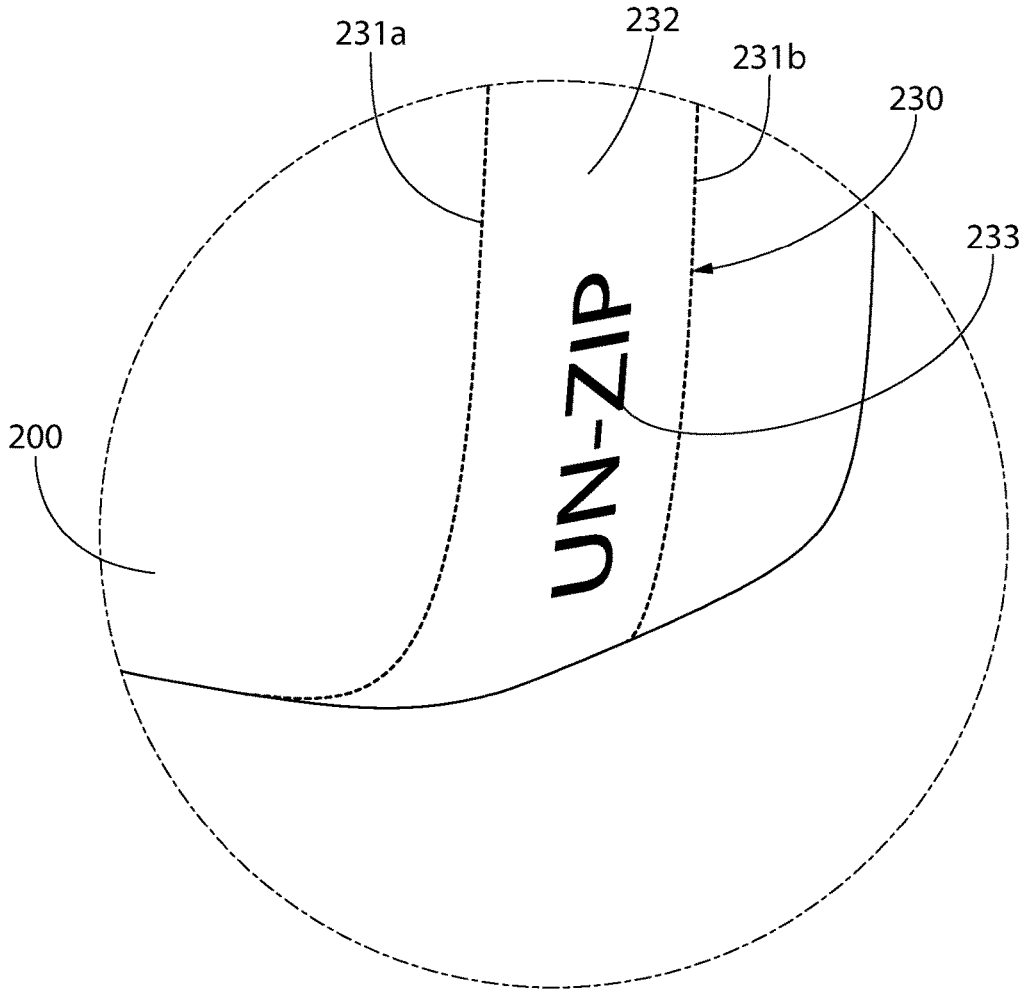
FIG. 7 is a close-up view of area VII of FIG. 1B.
Figure 8:
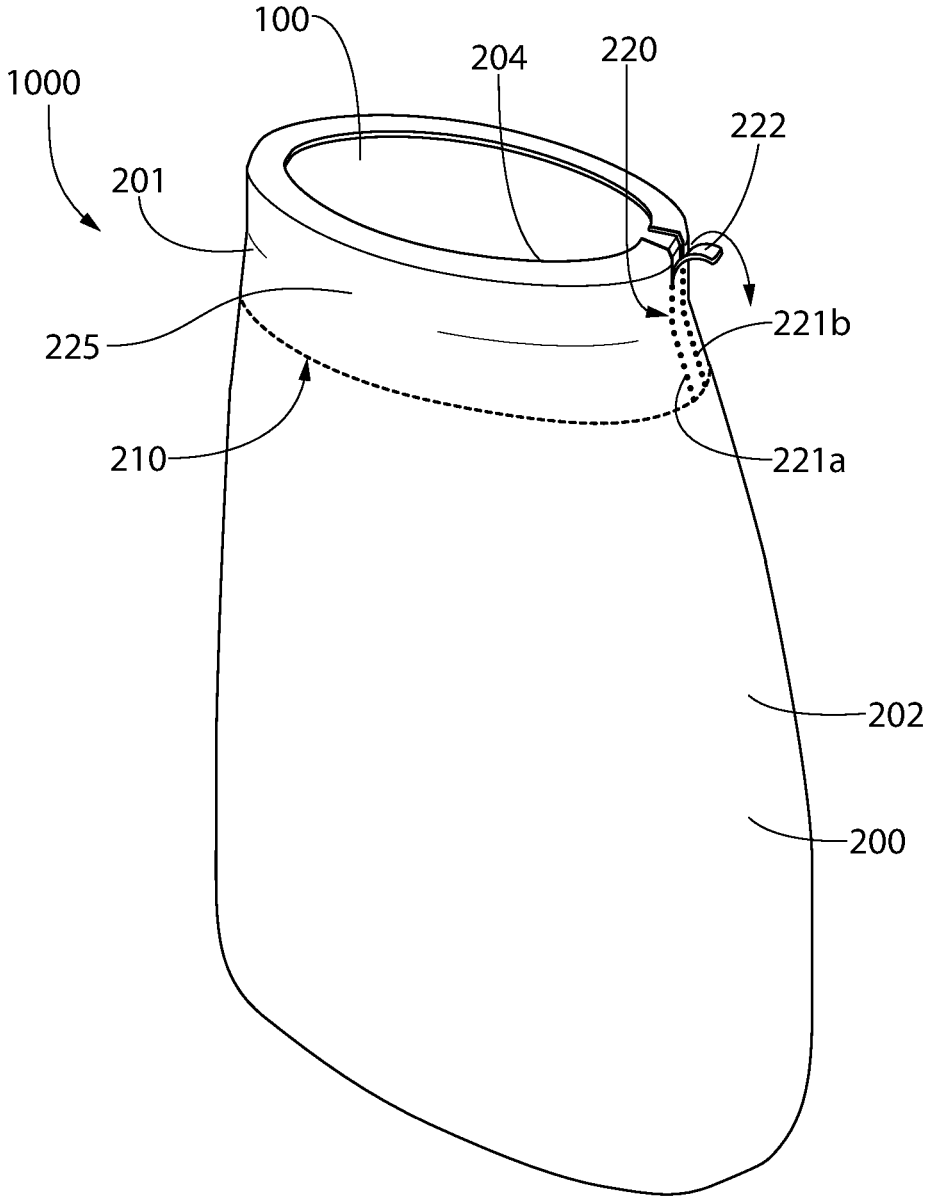
FIG. 8 is a rear perspective view of the container apparatus of FIG. 1B illustrating the sleeve being torn along a second pre-weakened section.

Referring briefly to FIGS. 1B and 7, in the exemplified embodiment the second removable strip 232 comprises indicia 233 thereon that comprises instructions for tearing away or otherwise removing the first removable strip 232 from the remainder of the second portion 202 of the sleeve 200. In the exemplified embodiment, the indicia 233 is the word "UN-ZIP." However, the specific details of the indicia 233 are not to be limited to that which is shown in the exemplified embodiment. In the exemplified embodiment, the container 100 has a height measured between the bottom and top ends 101, 102 of the container 100. Furthermore, in the exemplified embodiment the indicia is located on the second removable strip 232 along a bottom one-fifth, one-sixth, one-seventh, or one-eighth of the height of the container 100. This is intended to instruct a user to tear away the second removable strip 232 from the first end 233 of the third pre-weakened section 230 upwards rather than from the second end 234 of the third pre-weakened section 230 downwards.

In the exemplified embodiment, the indicia 233 comprises words only. In other embodiments, the indicia 233 may comprise both words and an illustration, such as the design of a zipper, arrows, or the like to further indicate or instruct to the user to tear the second removable strip 232. The purpose here is to urge the consumer to remove the sleeve 200 in its entirety before recycling to ensure that the container 100 will be recycled. Although indicia is only illustrated on the second removable strip 232 in the figures, in some embodiments the first removable strip 222 may also include some type of indicia (such as arrows or the like) indicative of the tearing action required by the user to tear and separate the first portion 201 of the sleeve 200 from the second portion 202 of the sleeve 200 and from the container 100.

Referring now to FIGS. 8-13, the steps involved in removing the sleeve 200 from the container 100 will be described. When a consumer purchases the container apparatus 1000, it has the appearance as shown in FIGS. 1A and 1B with the sleeve 200 circumscribing the container 100 along a portion or the entirety of its height. The sleeve 200 circumscribes the container 100 along its entire height in the exemplified embodiment, but may only circumscribe the container 100 along a portion of its height in other embodiments as described herein. In this manner, the sleeve 200 operates as a tamper-evident feature because while the sleeve 200 is circumscribing the container 100, it prevents the cap 140 from being opened and prevents the contents of the container 100 from being dispensed. It is only after the sleeve 200, or a portion thereof, is removed from the container 100 that the material contained in the container 100 may be dispensed.

Once it is desired to begin to use the container apparatus 1000 to dispense its contents, a consumer (or any other person) first begins the process of tearing the sleeve 200 along the second pre-weakened section 220. As collectively illustrated in FIGS. 8-10A, tearing along the second pre-weakened section 220 and the first pre-weakened section 210 detaches the first portion 201 of the sleeve 200 from the second portion 202 of the sleeve 200 and separates the first portion 201 of the sleeve 200 from the container 100 while the second portion 202 of the sleeve 200 remains wrapped around the container 100. Once the first portion 201 of the sleeve 200 is detached from the second portion 202 of the sleeve 200 and removed or otherwise separated from the container 100, the cap 140 is permitted to be altered between the closed and open states (FIGS. 10A, 10B).

Figure 9:
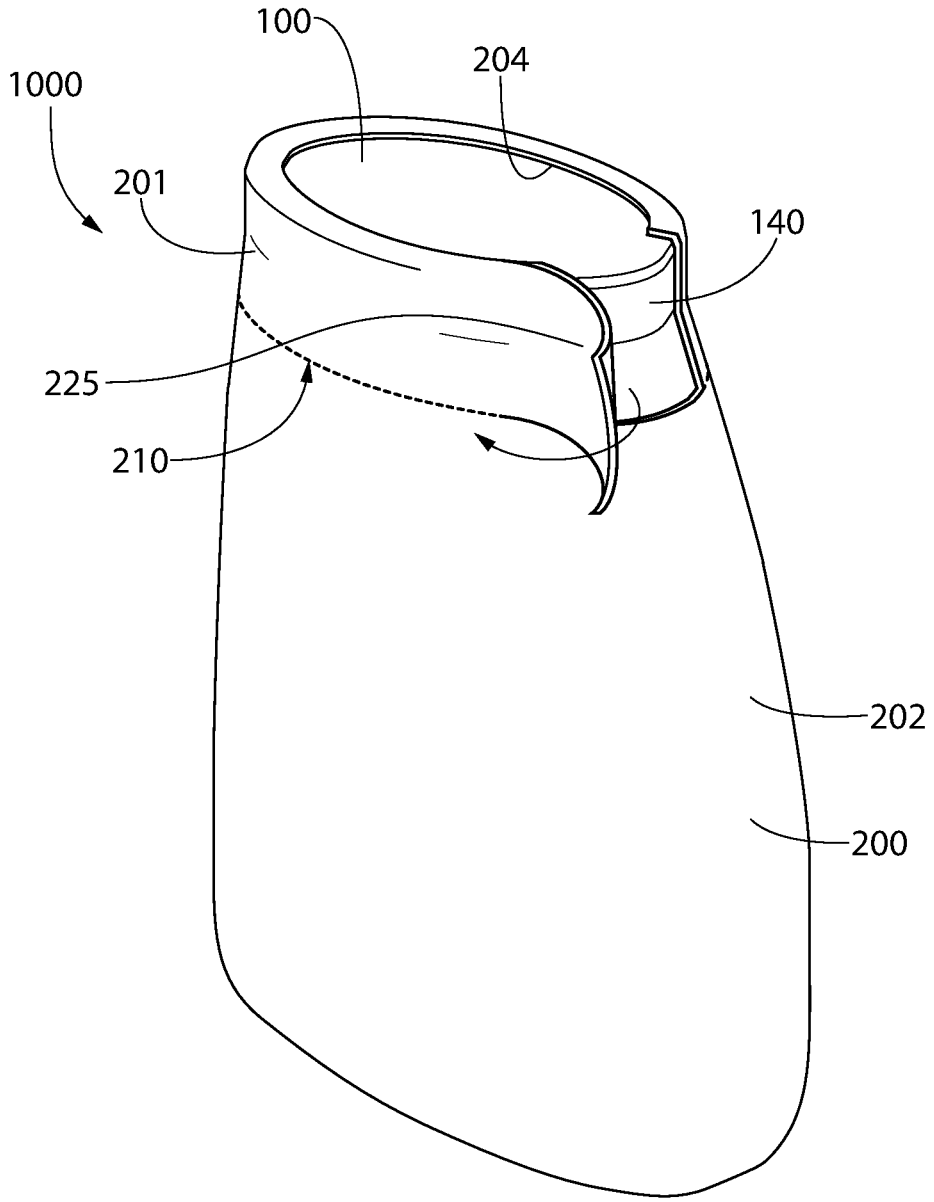
FIG. 9 is a rear perspective view of the container apparatus of FIG. 1B illustrating the sleeve being torn along a first pre-weakened section to detach a first portion of the sleeve from a second portion of the sleeve.

More specifically, in the exemplified embodiment removal of the first portion 201 of the sleeve 200 is achieved as follows. First, a user grips the first removable strip 222 at the top edge 204 of the sleeve 200 and pulls the first removable strip 222 away from the container 100, thereby causing the first pre-weakened section 220 to tear at both of the pair of pre-weakened lines 221*a*, 221*b*. Of course, in embodiments that only include a single pre-weakened line rather than the pair of pre-weakened lines 221*a*, 221*b*, this same tearing can be achieved by simply tearing along the single pre-weakened line rather than tearing away a removable strip. In the exemplified embodiment, the first removable strip 222 is continued to be torn from the sleeve 200 until the first removable strip 222 is completely torn away from a remaining section 225 of the first portion 201 of the sleeve 200 (FIG. 9). At this point, the remaining section 225 of the first portion 201 of the sleeve 200 remains circumscribing the container 100 while the first removable strip 222 is completely detached from the sleeve 200 and from the container 100. The sleeve 200 is then torn along the first pre-weakened section 210, thereby detaching the remaining section 225 of the first portion 201 of the sleeve 200 from the second portion 202 of the sleeve 200. The sleeve 200 is shrink wrapped onto the container 100 without the use of a fixing mechanism such as adhesive, so once torn along the pre-weakened sections the sleeve 200 or portions thereof are readily separated from the container 100. This detaching of the remaining section 225 of the first portion 201 of the sleeve 200 from the second portion 202 of the sleeve 200 also simultaneously separates the remaining section 225 of the first portion 201 of the sleeve 200 from the container 100. The result of these steps is the container apparatus 1000 as it appears in FIG. 10A with the first portion 201 of the sleeve 200 separated or removed from the container 100 and the first portion 202 of the sleeve 200 remaining wrapped around the container 100.

Importantly, as noted above the second pre-weakened section 220 is not axially aligned with, but rather is circumferentially offset from, the third pre-weakened section 230. As used herein, the phrase circumferentially offset is not intended to be limiting of the cross-sectional shapes of the container 100 and the sleeve 200. Specifically, the term circumferentially does not exclude containers 100 and sleeves 200 that have non-circular cross-sectional areas. Rather, in certain embodiments the second pre-weakened section 220 is angularly offset from the third pre-weakened section 230 about a perimeter or periphery of the geometry of the particular container forming a part of the container apparatus 1000. More specifically, the first point P1 at which the second pre-weakened section 220 (or the second tear line TL2) intersects the first pre-weakened section 210 (or the first tear line TL1) is circumferentially offset from the second point P2 at which the third pre-weakened section 230 (or the third tear line TL3) intersects the first pre-weakened section 210 (or the first tear line TL1). Thus, during the tearing away of the first removable strip 222, at the intersection of the second pre-weakened section 220 with the first pre-weakened section 210, there is no option for the user to continue tearing axially to tear the sleeve 200 along the second portion 202 thereof. Rather, the user must first tear along the first pre-weakened section 210 and can only access the third pre-weakened section 230 (other than from the bottom edge 203 of the sleeve 200) once the first portion 201 of the sleeve 200 is removed. Thus, rather than continuing to tear the entire sleeve 200, which is undesirable because the second portion 202 of the sleeve 200 is intended to remain on the container 100 until it is time to recycle the container 100, the second portion 202 of the sleeve 200 remains intact on the container 100.

Figure 10A:
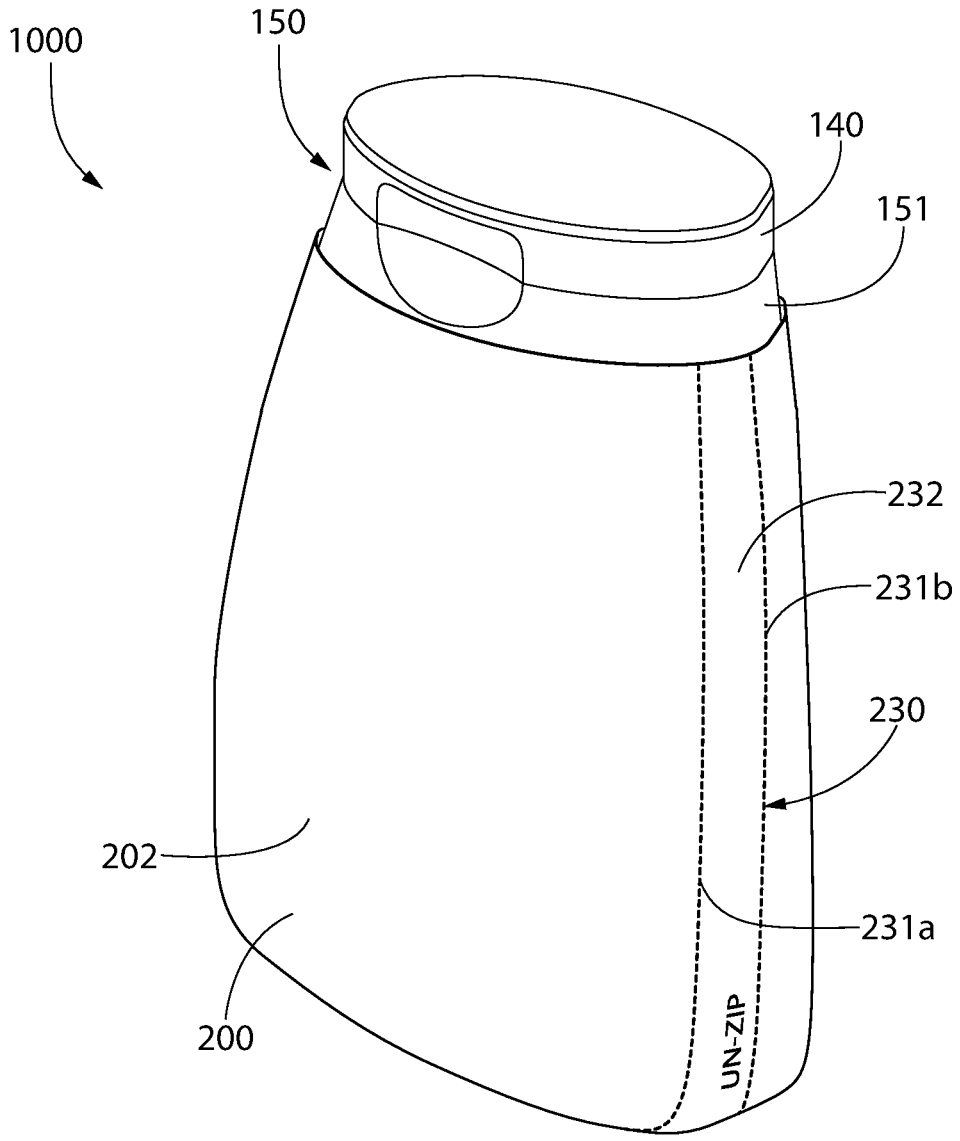
FIG. 10A is a front perspective view of the container apparatus of FIG. 1B with the first portion of the sleeve separated from the container with a cap of the container in a closed state.
Figure 10B:
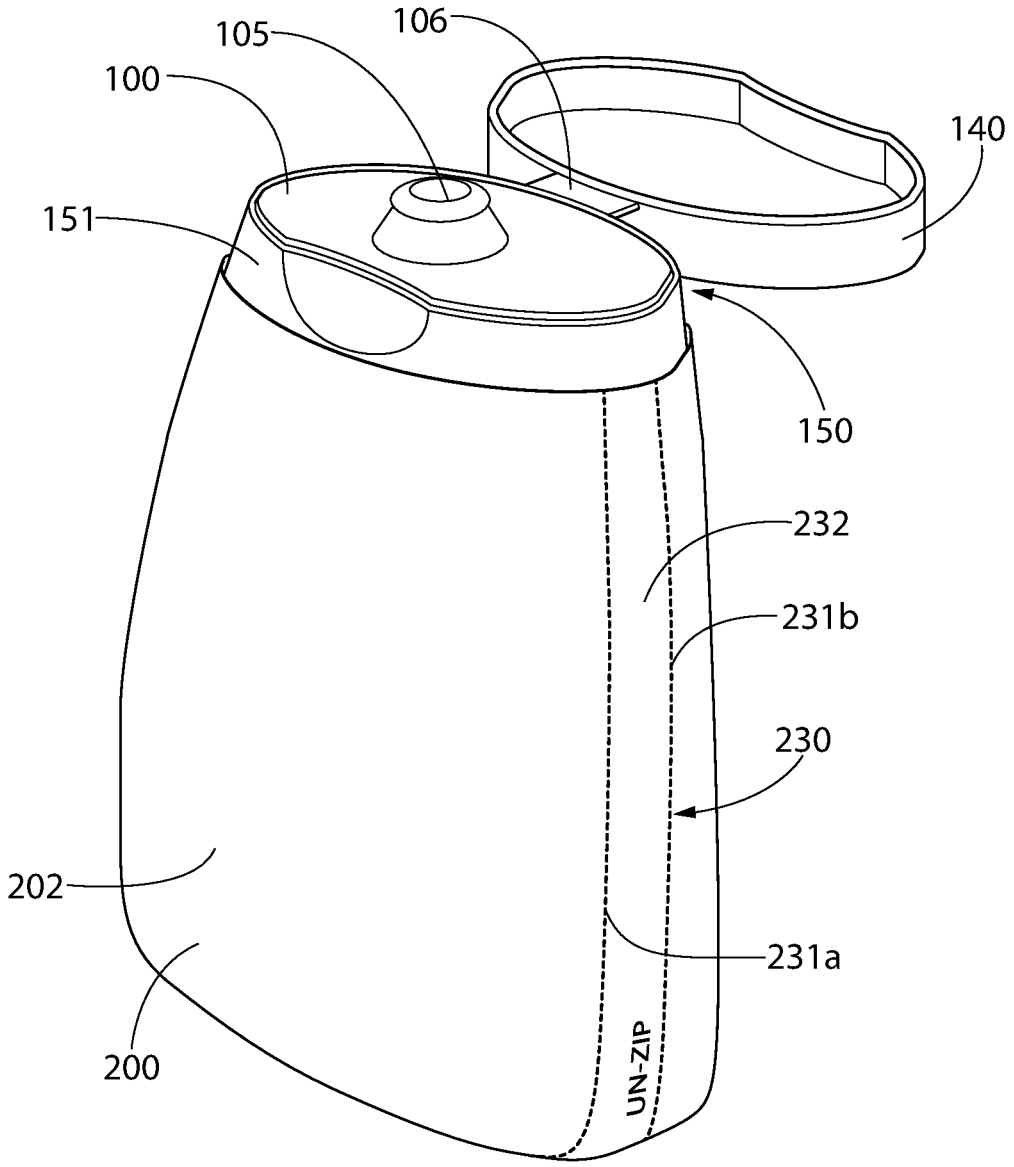
FIG. 10B is a front perspective view of the container apparatus of FIG. 1B with the first portion of the sleeve separated from the container with the cap of the container in an open state.
Figure 11:
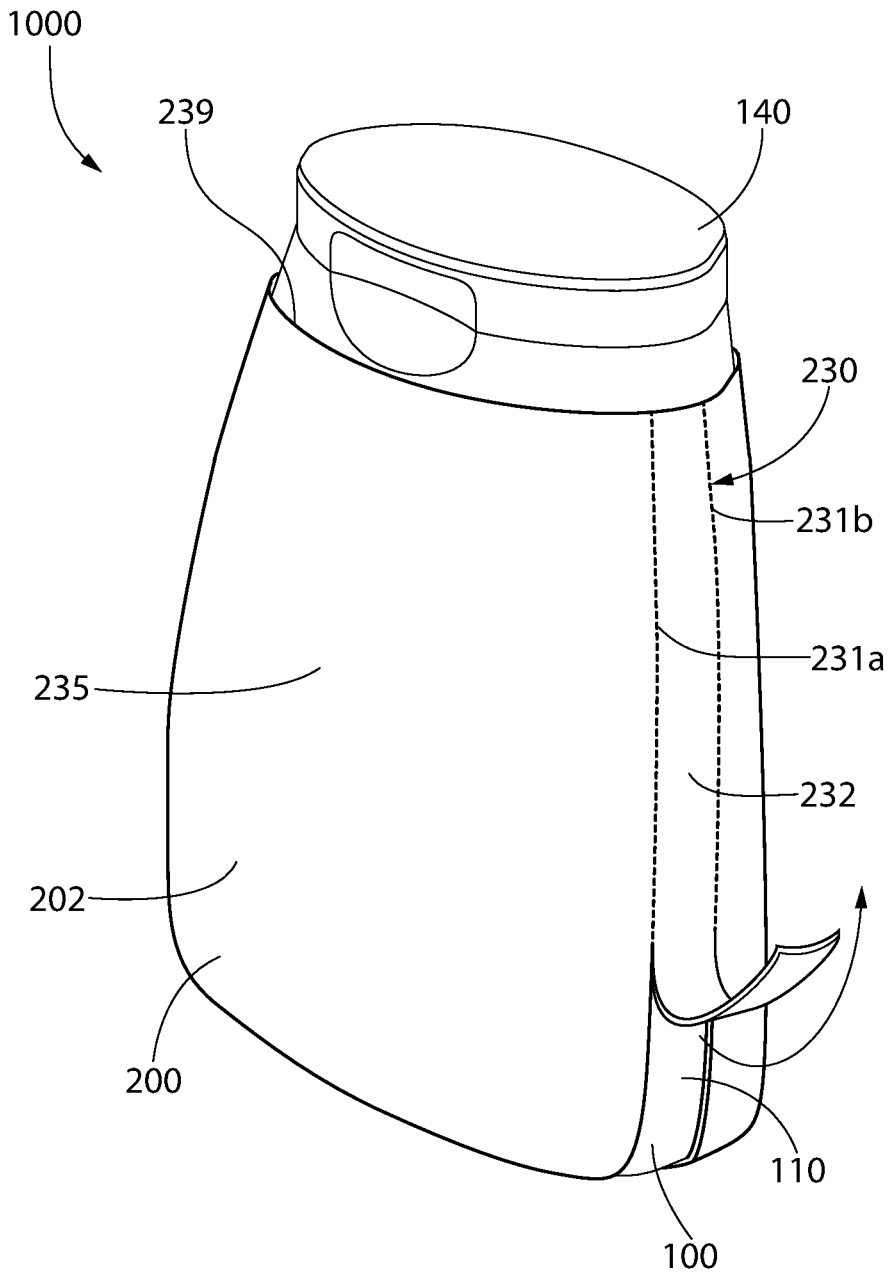
FIG. 11 is a front perspective view of the container apparatus of FIG. 1B illustrating the sleeve being torn along a third pre-weakened section.

Referring to FIGS. 10A and 10B concurrently, once the first portion 201 of the sleeve 200 is removed from the container 100, the cap 140 can be altered between first and second (or closed and open) states. FIG. 10A illustrates the container apparatus 1000 with the first portion 201 of the sleeve 200 removed from the container 100 and the cap 140 in the closed state. FIG. 10B illustrates the container apparatus 1000 with the first portion 201 of the sleeve 200 removed from the container 100 and the cap 140 in the open state. In the exemplified embodiment, the cap 140 is coupled to the body 110 of the container 100 via a hinge 106 such that the cap 140 is coupled to the container 100 in both the open and closed states. In the exemplified embodiment, the skirt portion 151 of the lid assembly 150 is coupled to the body 110, and the cap 140 is coupled to the skirt portion 151 via the hinge 106. However, in other embodiments the cap 140 may be completely separated or detached from the container 100 in the open state. In such embodiments, the cap 140 may be coupled to the container 100 via a snap-fit arrangement, mating screw threads, or the like. Thus, variations in the overall structure of the container 100 are possible and remain within the scope of the concepts disclosed herein.

After the contents or material contained within the container 100 are depleted, the consumer will either throw the container 100 in the trash or recycle the container 100. The goal is to have the consumer recycle the container 100. As discussed above, many municipalities require that the sleeve 200 be completely removed from the container 100 in order for the container 100 to be properly recycled. Therefore, with reference to FIGS. 11-13, once the container 100 is emptied of its contents, the consumer will begin the process of separating the second portion 202 of the sleeve 200 from the container 100.

In the exemplified embodiment, this is accomplished as follows. The consumer grips the second removable strip 232 of the third pre-weakened section 230 and pulls it to cause the third pre-weakened section 230 to tear along the second pair of pre-weakened lines 231*a*, 231*b*. In the exemplified embodiment, the second removable strip 232 is gripped along a bottom of the container 100 at the bottom edge 203 of the sleeve 200, but the consumer may also grip the second removable strip 232 from a top edge 239 of the second portion 232 of the sleeve 200. Furthermore, although the exemplified embodiment uses a pair of pre-weakened lines 231*a*, 231*b* and a removable strip 232, this may also be achieved with a single pre-weakened line. The second removable strip 232 may include a tab that protrudes from the bottom end 101 of the container 100 to enhance a consumer's ability to grip the second removable strip 232 to tear it away as described herein.

Figure 12:
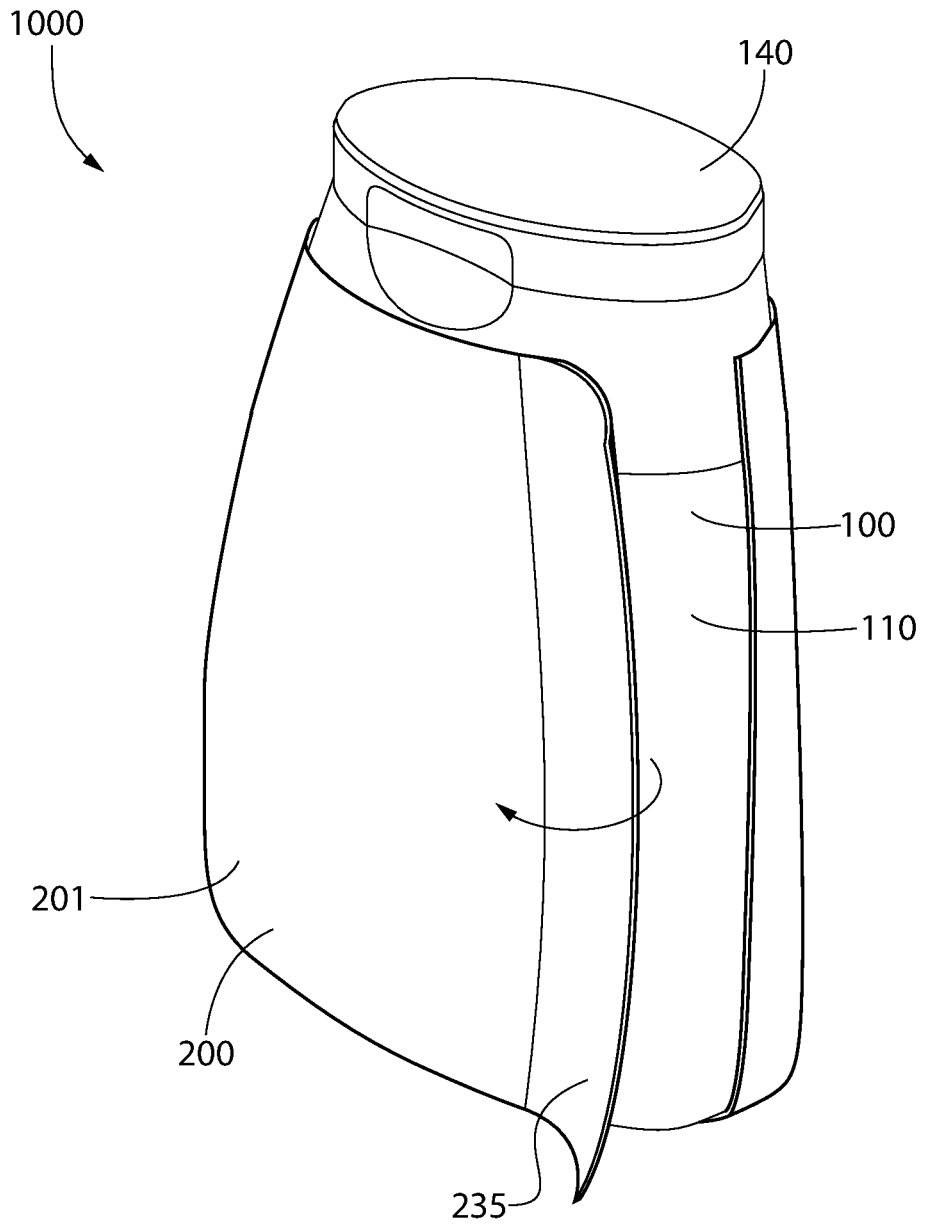
FIG. 12 is a front perspective view of the container apparatus of FIG. 1B illustrating the second portion of the sleeve being separated from the container.
Figure 13:
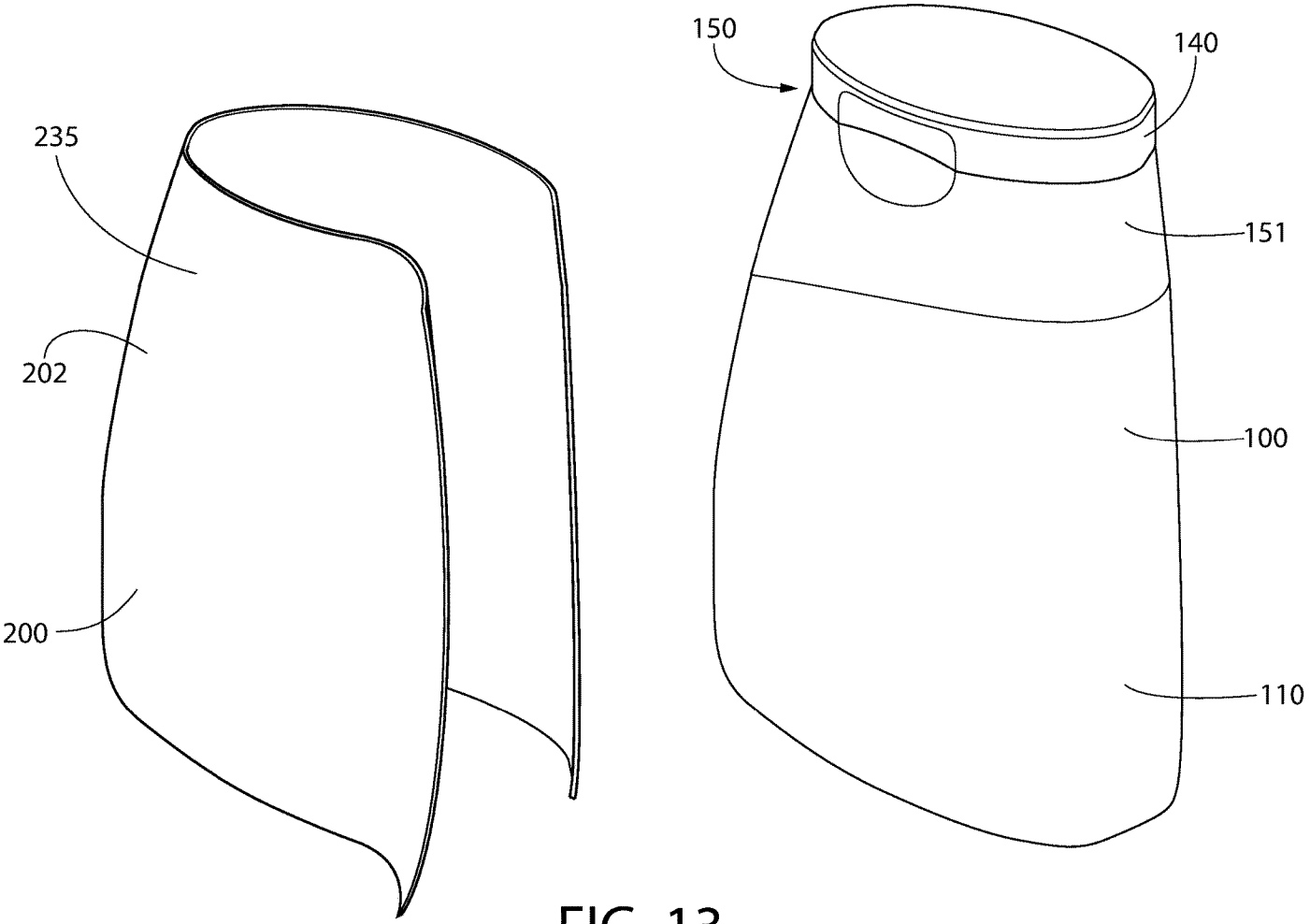
FIG. 13 is a front perspective view illustrating the container and the second portion of the sleeve separated therefrom.
Figure 14:
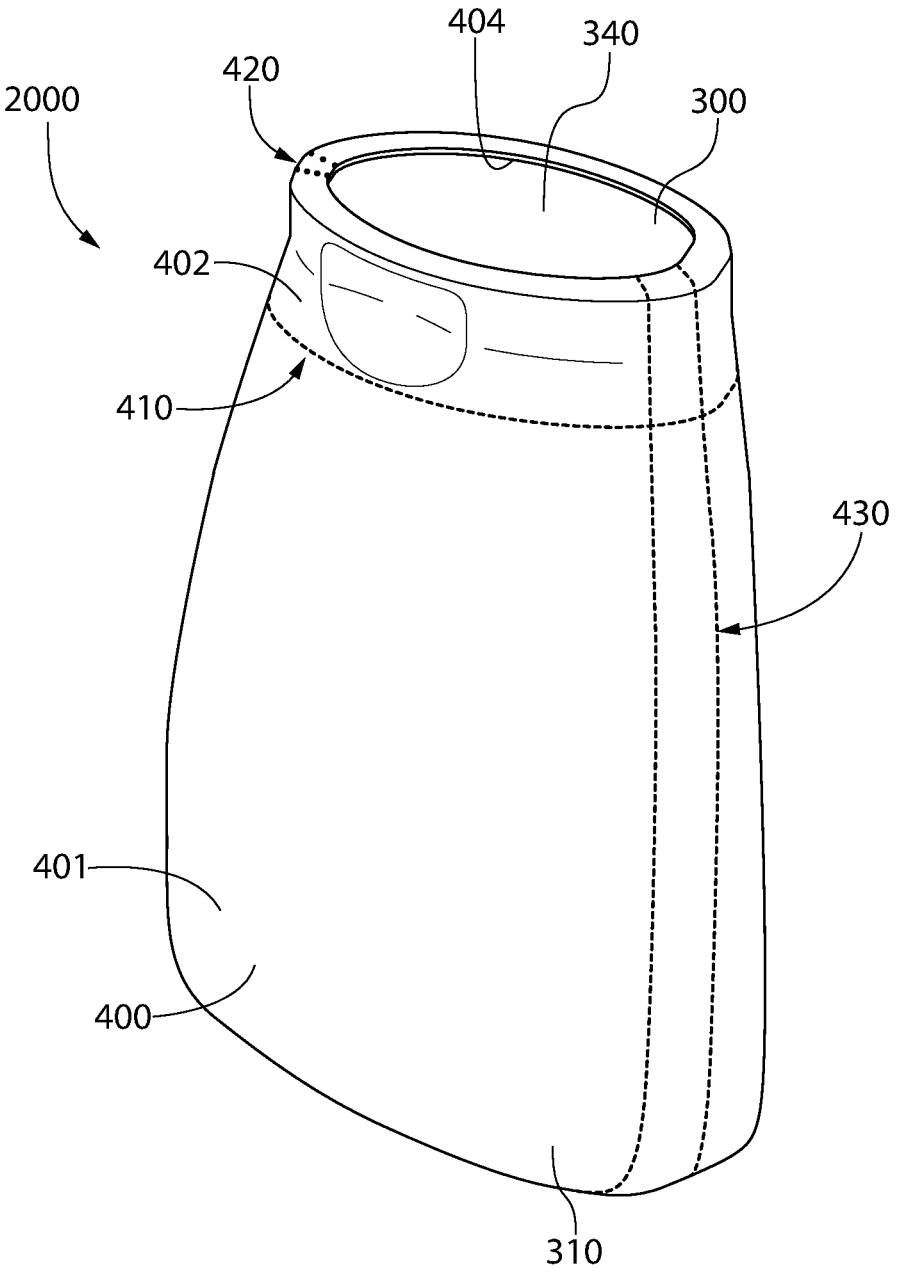
FIG. 14 is a front perspective view of a container apparatus illustrating a container with a sleeve thereon in accordance with another embodiment of the present invention.
Figure 15:
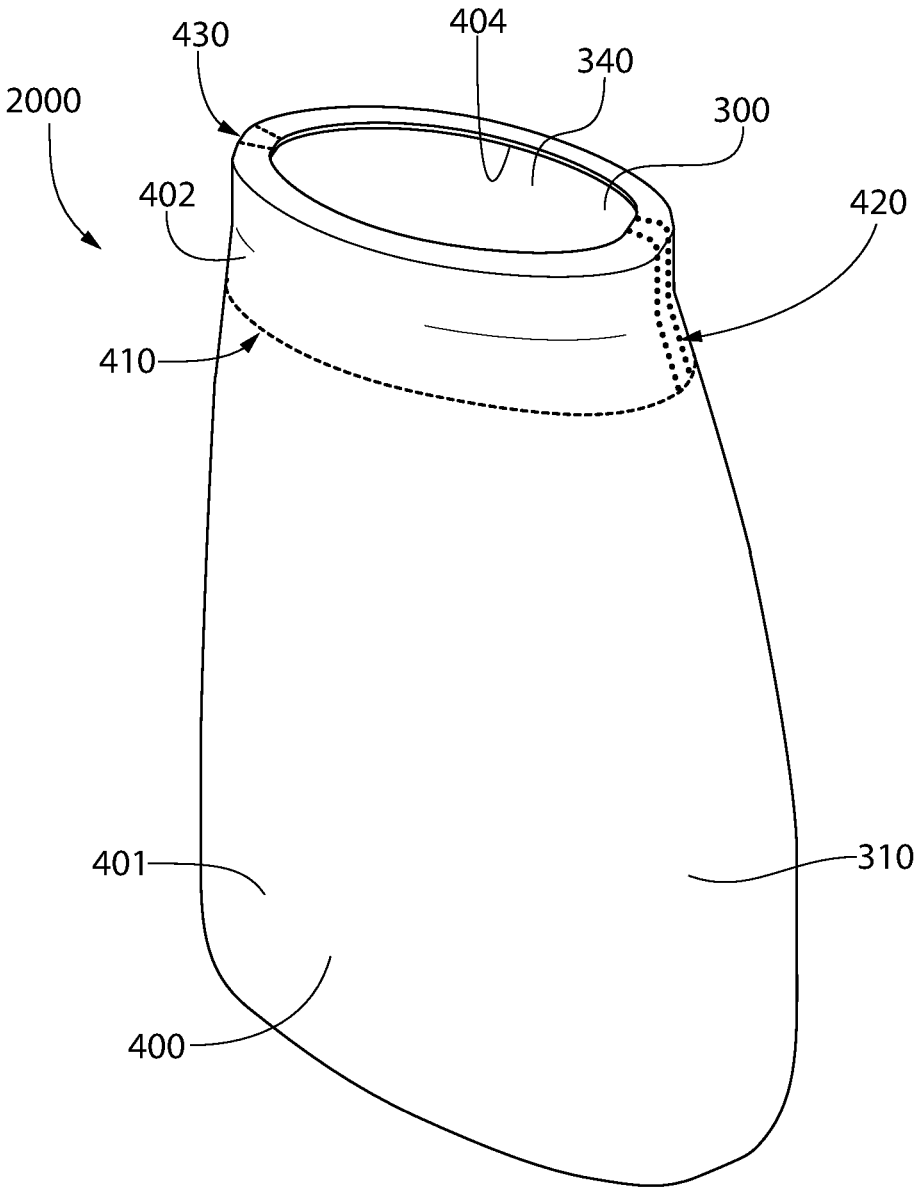
FIG. 15 is a rear perspective view of the container apparatus of FIG. 14.
Figure 16:
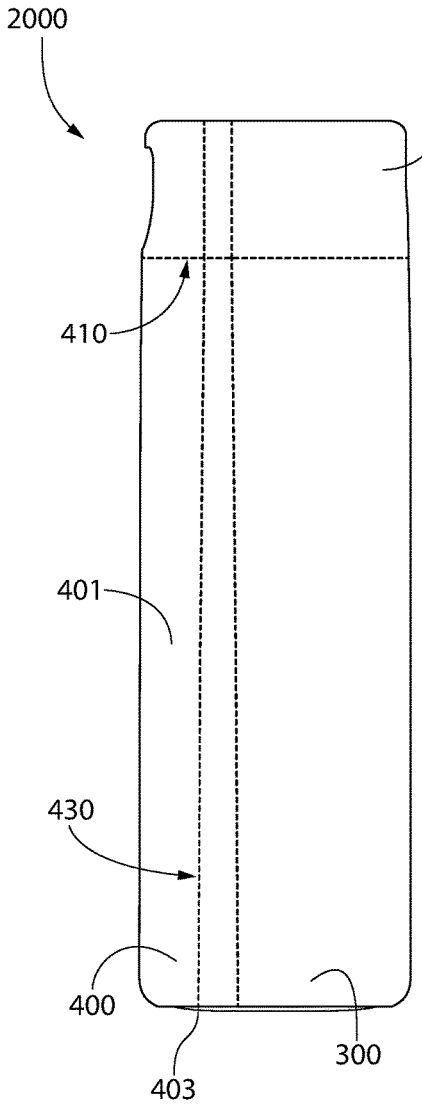
FIG. 16 is a right-side view of the container apparatus of FIG. 14.
Figure 17:
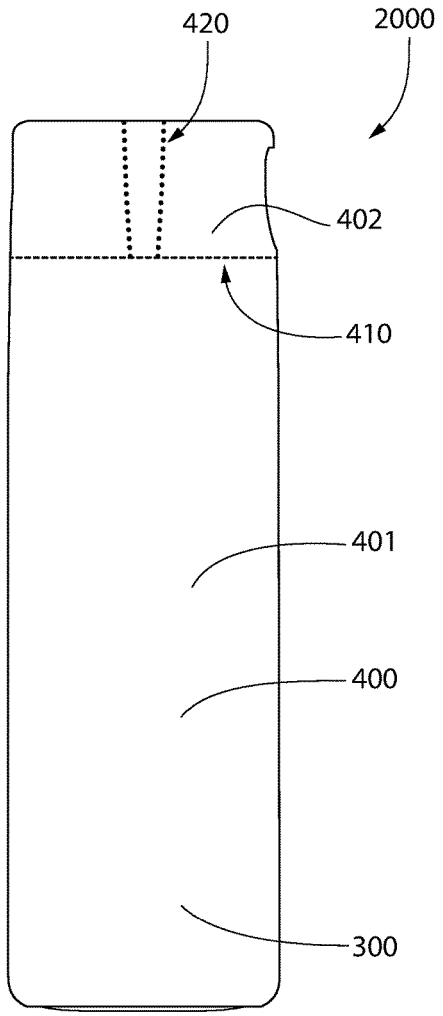
FIG. 17 is a left-side view of the container apparatus of FIG. 14.

In the exemplified embodiment, the second removable strip 232 is torn until it is completely torn away from a remaining section 235 of the second portion 202 of the sleeve 200. At this point, the remaining section 235 of the second portion 202 of the sleeve 200 is no longer actively affixed or secured to the container 100 (due to the lack of adhesive or other fixing mechanism as described above) and the remaining section 235 of the second portion 202 of the sleeve 200 can be readily separated from the container 100 as illustrated in FIG. 12. FIG. 13 illustrates the result of this process with the remaining section 235 of the second portion 202 of the sleeve 200 completely separated from the container 100. The container 100 is now ready for recycling.

In certain embodiments of the invention described herein, one of the first, second, and third pre-weakened sections 210, 220, 230 may have different tear strengths than the others of the first, second, and third pre-weakened sections 210, 220, 230. As used herein, tear strength is a measure of how well a material can withstand the effects of tearing. Thus, a pre-weakened section with a greater tear strength is able to withstand the effects of tearing more than a pre-weakened section with a lesser tear strength. Stated a different way, a pre-weakened section of a material with a greater tear strength will require a greater tearing force to be applied to it in order to tear the material at that pre-weakened section than a pre-weakened section with a lesser tear strength. As an example, if the third pre-weakened section 230 has a tear strength that is greater than the tear strength of the first pre-weakened section 210, it is more difficult to tear the sleeve 200 at the third pre-weakened section 230 than at the first pre-weakened section 210 and a greater tearing force would need to be applied to tear the sleeve 200 at the third pre-weakened section 230 than at the first pre-weakened section 210. This will facilitate maintaining the second portion 202 of the sleeve 200 intact on the container 100 even after the first portion 201 of the sleeve 200 is removed or separated from the container 100.

The tear strengths of the first, second, and third pre-weakened sections 210, 220, 230 of the sleeve 200 may be controlled in several manners. Specifically, the tear strength may be controlled by the material used to form the pre-weakened sections 210, 220, 230 of the sleeve 200 or the thickness of the material used to form the pre-weakened sections 210, 220, 230 of the sleeve 200. Alternatively, where the pre-weakened sections 210, 220, 230 are formed by perforations, the tear strength may be controlled by control ling the size of the perforated regions relative to the size of the non-perforated regions. In still other embodiments, the tear strength may be controlled by adjusting the spacing between the perforated regions. Various combinations of these techniques and others that are known to persons skilled in the art may be used to control the tear strength of the sleeve 200 at the first, second, and third pre-weakened sections 210, 220, 230 to achieve a desired purpose.

In the exemplified embodiment, the first pre-weakened section 210 has a first tear strength, the second pre-weakened section 220 has a second tear strength, and the third pre-weakened section 230 has a third tear strength. In certain embodiments, it may be preferable that the third tear strength is greater than the first tear strength. This may be desirable to prevent inadvertent tearing along the third pre-weakened section 230 when the sleeve 200 is being torn at the first pre-weakened section 210. Specifically, by having the third tear strength be greater than the first tear strength, a lesser force is required to tear along the first pre-weakened section 210 than along the third pre-weakened section 230. Thus, as a user is tearing along the first pre-weakened section 210 and approaches the third pre-weakened section 230, an increase in force would be required to tear along the third pre-weakened section 230, which reduces the likelihood of an accidental tear that would result in a premature removal of the second section 202 of the sleeve 200 from the container 100.

In certain embodiments, the third tear strength may also be greater than the second tear strength, although this is not required in all embodiments. In other embodiments the second tear strength may be greater than the third tear strength. The first and second tear strengths may be equal, or any one of the first and second tear strengths may be greater than the other. In some embodiments, the second tear strength is greater than the first tear strength so that as a user is tearing the sleeve 200 along the second pre-weakened section 220, the user's force will also be sufficient to tear the sleeve 200 along the first pre-weakened section 210, which will assist in easily removing the first portion 201 of the sleeve 200 from the container 100. In certain embodiments, it is merely preferable that one of the first, second, and third tear strengths is different than at least one of the other of the first, second, and third tear strengths. In another embodiment it is merely preferable that the third tear strength is greater than the first tear strength. Furthermore, in some embodiments it may be preferable that the second tear strength is greater than the first tear strength and that the third tear strength is greater than the first tear strength. This will facilitate separating the first portion 201 of the sleeve 200 from the second portion 202 of the sleeve 200 while leaving the second portion 202 of the sleeve 200 intact on the container 100. In certain embodiments, it may be preferable that the second tear strength is greater than the third tear strength and the third tear strength is greater than the first tear strength. The disclosure of the various tear strengths that are possible may be utilized in conjunction with any of the embodiments of the container apparatus 1000, 2000, 3000 described herein.

Referring now to FIGS. 14-18, a container apparatus 2000 will be described in accordance with an alternative embodiment of the present invention. The container apparatus 2000 is identical to the container apparatus 1000 discussed above except with regard to the differences specifically identified herein below. The container apparatus 2000 will be similarly numbered to the container apparatus 1000 except that the 300-series of numbers will be used to denote the container and its features and the 400-series of numbers will be used to denote the sleeve and its features. For features of the container apparatus 2000 that are numbered and not described, the description of the similarly numbered feature of the container apparatus 1000 is applicable. All of the other disclosure above except that which conflicts with the below is applicable to the container apparatus 2000, including the disclosure with regard to materials, tear strengths, methods of manufacturing, and the like.

The container apparatus 2000 generally comprises a container 300 having a body 310 and a cap 340 and a sleeve 400 that is wrapped around the container 300 in the same manner as discussed above with regard to the container apparatus 1000. The container 300 is identical to the container 100 in all respects and the structural details of the exemplified and alternative embodiments will not be described herein in the interest of brevity, it being understood that the description above is applicable. The difference between the container apparatus 2000 and the container apparatus 1000 lies in the structure of the sleeve 400. Specifically, the sleeve 400 comprises a first pre-weakened section 410, a second pre-weakened section 420, and a third pre-weakened section 430. The first pre-weakened section 410 divides the sleeve 400 into a first portion (upper portion) 401 and a second portion (lower portion) 402. The first portion 401 of the sleeve comprises the second pre-weakened section 420 and the second portion 402 of the sleeve 400 comprises the third pre-weakened section 430.

The first and second pre-weakened sections 410, 420 of the sleeve 400 are identical to the first and second pre-weakened sections 210, 220 of the sleeve 200. However, the third pre-weakened section 430 of the sleeve 400 is slightly different than the third pre-weakened section 230 of the sleeve 200. The sleeve 400 extends from a bottom edge 403 to a top edge 404. In this embodiment, the third pre-weakened section 430 of the sleeve 400 extends the entire length of the sleeve 400 from the bottom edge 403 to the top edge 404. Thus, in this embodiment the third pre-weakened section 430 is located in both the first and second portions 401, 402 of the sleeve 400. This is different than the third pre-weakened section 230 of the sleeve 200 which extends from the bottom edge 203 of the sleeve 200 to the first pre-weakened section 210 of the sleeve 200 and is located only in the first portion 201 of the sleeve 200 but not also in the second portion 202 of the sleeve 200.

By forming the third pre-weakened section 430 to extend the entire length of the sleeve 400, the added functionality of being able to remove the entire sleeve 400 from the container 300 by tearing only the third pre-weakened section 430 of the sleeve 400 is available. Thus, with this embodiment the first portion 401 of the sleeve 400 may be detached from the second portion 402 of the sleeve 400 by tearing along the second pre-weakened section 420 and then the first pre-weakened section 410 of the sleeve 400. This will leave the second portion 402 of the sleeve 400 intact on the container 300. The second portion 402 of the sleeve 400 can then be removed from the container 300 at a later time by tearing along the third pre-weakened section 430 of the sleeve 400. This is similar to the functionality described above with regard to the container apparatus 1000. However, with the embodiment of the container apparatus 2000, if desired the entire sleeve 400 may be removed from the container 300 at once by tearing along the entirety of the third pre-weakened section 430 of the sleeve 400.

Figure 18:
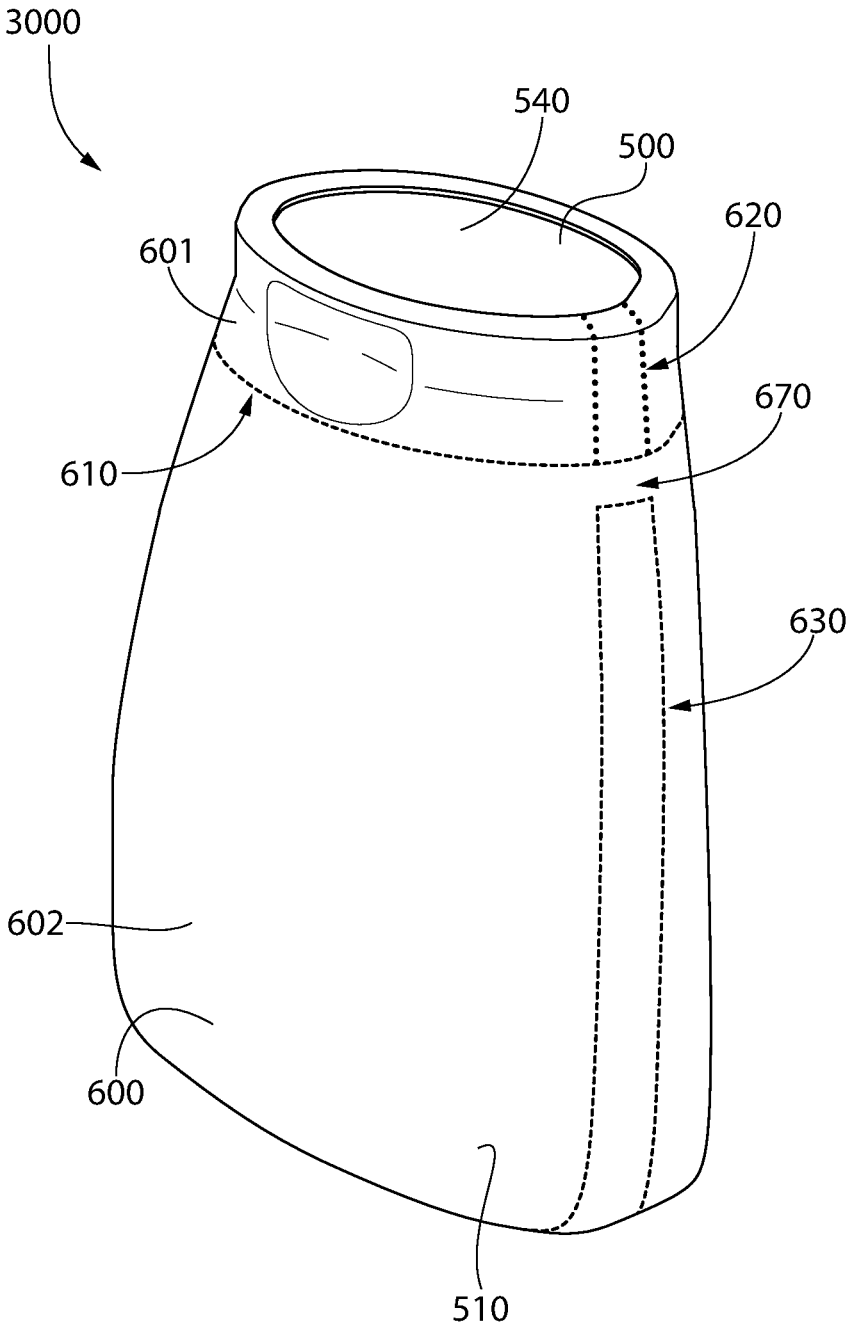
FIG. 18 is a front perspective view of a container apparatus illustrating a container with a sleeve thereon in accordance with yet another embodiment of the present invention.
Figure 19:
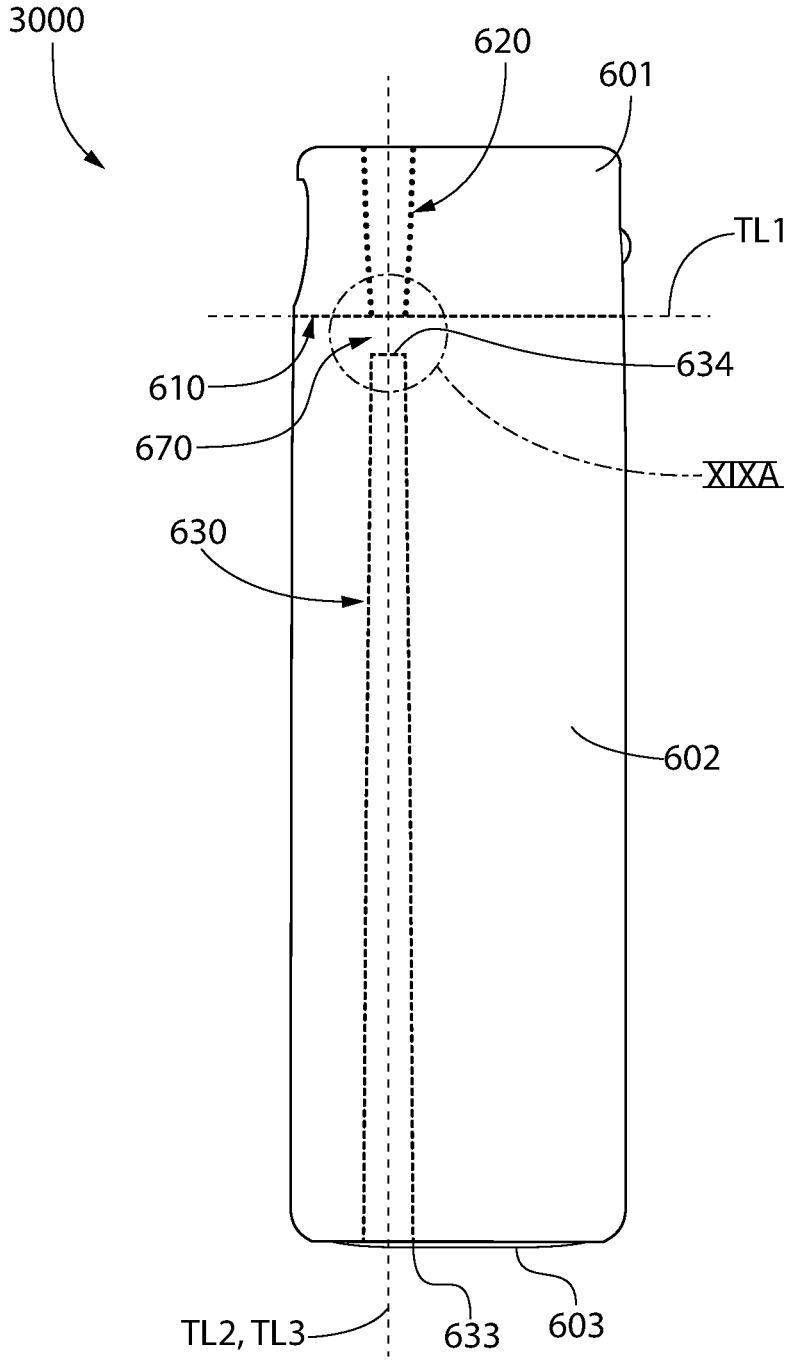
FIG. 19 is a right-side view of the container apparatus of FIG. 18.
Figure 19A:
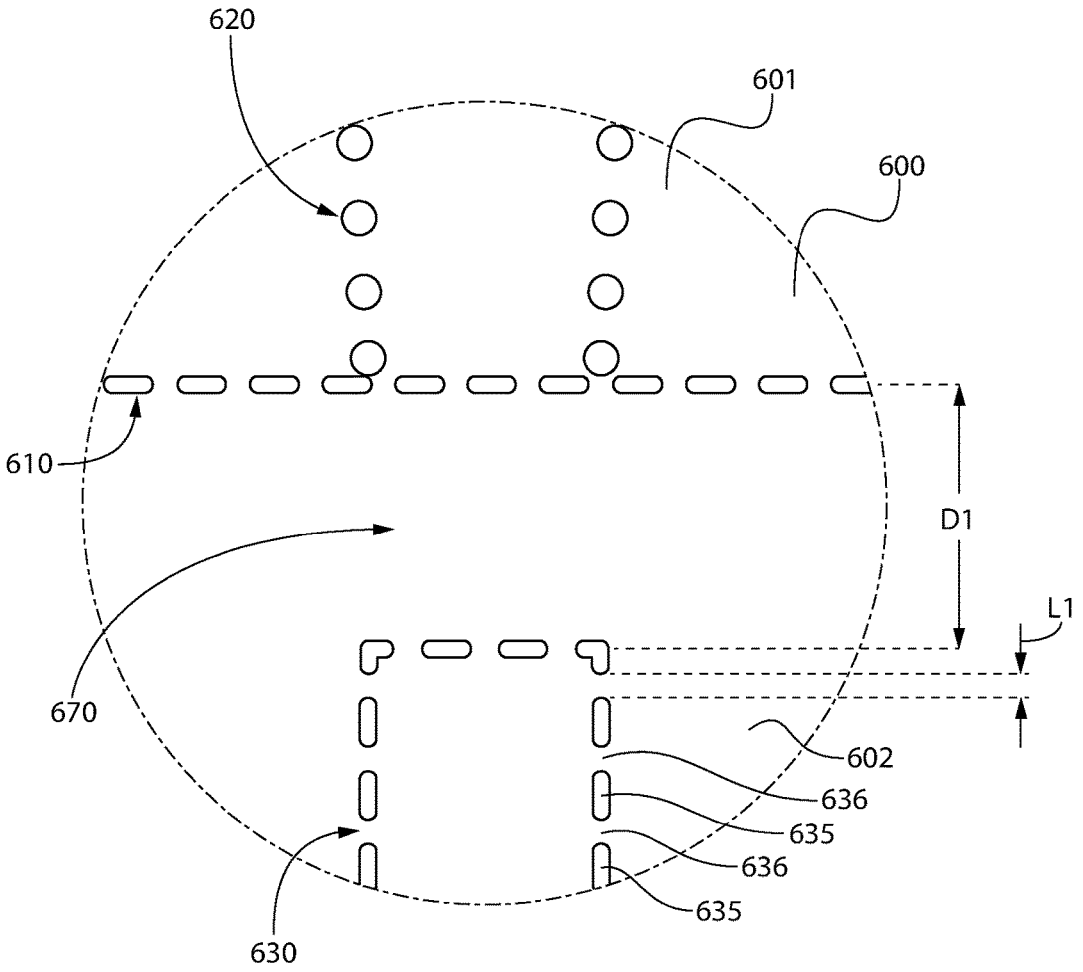
FIG. 19A is a close-up of area XIX of FIG. 18.

Referring to FIGS. 18-19A, a container apparatus 3000 will be described in accordance with an alternative embodiment of the present invention. The container apparatus 3000 is identical to the container apparatuses 1000, 2000 discussed above except with regard to the differences specifically identified herein below. The container apparatus 3000 will be similarly numbered to the container apparatuses 1000, 2000 except that the 500-series of numbers will be used to denote the container and its features and the 600-series of numbers will be used to denote the sleeve and its features. For features of the container apparatus 3000 that are numbered and not described, the description of the similarly numbered feature of the container apparatuses 1000, 2000 is applicable. All of the other disclosure above except that which conflicts with the below is applicable to the container apparatus 3000, including the disclosure with regard to materials, tear strengths, methods of manufacturing, and the like.

The container apparatus 3000 generally comprises a container 500 having a body 510 and a cap 540 and a sleeve 600 that is wrapped around the container 500 in the same manner as discussed above with regard to the container apparatus 2000. The container 500 is identical to the containers 100, 300 in all respects and thus it will not be described herein in the interest of brevity, it being understood that the description above is applicable. The difference between the container apparatus 3000 and the container apparatus 1000 lies in the structure of the sleeve 600. Specifically, the sleeve 600 comprises a first pre-weakened section 610, a second pre-weakened section 620, and a third pre-weakened section 630. The first pre-weakened section 610 divides the sleeve 600 into a first portion (upper portion) 601 and a second portion (lower portion) 602. The first portion 601 of the sleeve 600 comprises the second pre-weakened section 620 and the second portion 602 of the sleeve 600 comprises the third pre-weakened section 630.

The first and second pre-weakened sections 610, 620 of the sleeve 600 are identical to the first and second pre-weakened sections 210, 220 of the sleeve 200. However, the third pre-weakened section 630 of the sleeve 400 is slightly different than the third pre-weakened section 230 of the sleeve 200. First, in the exemplified embodiment the third pre-weakened section 630 is in circumferential alignment with the second pre-weakened section 620 rather than the second and third pre-weakened sections 620, 630 being circumferentially offset as with the previous embodiments. Thus, in the exemplified embodiment the second tear line TL2 delineated by the second pre-weakened section 620 is coextensive with the third tear line TL3 delineated by the third pre-weakened section 630 and the points of intersection between the second and third tear lines TL2, TL3 and the first tear line TL1 of the first pre-weakened section 610 are the same. Of course, the invention is not to be so limited and in other embodiments the second and third pre-weakened sections 620, 630 may be circumferentially offset as with the container apparatuses 1000, 2000.

Despite the circumferential alignment between the second and third pre-weakened sections 620, 630, tearing the second pre-weakened section 620 does not readily result in tearing of the third pre-weakened section 630. In the exemplified embodiment, this is because the third pre-weakened section 630 is axially spaced apart from the second pre-weakened section 620 and from the first pre-weakened section 610 by a region 670 of the sleeve 600 (although in other embodiments this can be achieved due to variations in the tear strengths of the pre-weakened sections as discussed above). Thus, the second difference in the third pre-weakened section 630 of this embodiment is that the third pre-weakened section 630 extends from a first end 633 at or adjacent to the bottom end 603 of the sleeve 600 to a second end 634 that is at a location that is beneath and spaced apart from the first pre-weakened section 610 of the sleeve 600. In this usage, the term beneath is intended to mean that the second end 634 of the third pre-weakened section 630 is between the first pre-weakened section 610 and the bottom end 603 of the sleeve 600.

Thus, in the exemplified embodiment the second end 634 of the third pre-weakened section 630 is spaced apart from the first pre-weakened section 610 by an axial distance D1 measured along the second tear line TL2. Furthermore, in the exemplified embodiment the third pre-weakened section 630 comprises perforations, and specifically an alternating arrangement of perforated segments 635 and non-perforated segments 636. The perforated segments 635 are segments of the third pre-weakened section 630 that are devoid of material or at which the material of the sleeve 600 has been punctured or otherwise removed to form an aperture or hole through the sleeve 600. The non-perforated segments 636 are regions of the third pre-weakened section 630 that include the material of the sleeve 600 and that are located between adjacent ones of the perforated segments 635. This is a standard technique for creating pre-weakened regions or perforated regions of a material to render the material more susceptible to tearing at that region.

It should be noted that the axial distance D1 between the second end 634 of the third pre-weakened section 630 is not simply the space formed by the perforated segments 635 of the third pre-weakened section 630. In that regard, in the exemplified embodiment a maximum length L1 between adjacent ones of the perforated segments 635 (which is equal to a maximum length of the non-perforated segments 636) is less than the axial distance D1. Thus, the distance D1 between the second end 634 of the third pre-weakened section 630 is a greater spacing than the spacing between adjacent ones of the perforated segments 635. As a result, the region 670 of the sleeve 600 between the second end 634 of the third pre-weakened section 630 of the sleeve 600 and the first pre-weakened section 610 of the sleeve 600 is readily discernable.

Axially spacing the third pre-weakened section 630 from the first pre-weakened section 610 achieves the same effect of preventing premature removal of the second portion 602 of the sleeve 600 described above with regard to the other embodiments without requiring the circumferential offset in those embodiments. Specifically, as a user tears the sleeve 620 along the second pre-weakened section 620, upon reaching the first pre-weakened section 610 the sleeve 620 will stop tearing in an axial direction and will instead begin tearing in a circumferential direction along the first pre-weakened section 620. Due to the space in the region 670, continued axial tearing along the third pre-weakened section 630 is substantially prevented until a later time when it is desired to remove the entirety of the sleeve 600 from the container 500. When it is desired to remove the second portion 602 of the sleeve 600 from the container 100, the user can tear the third pre-weakened section 630 from the bottom end 633 upwards as described above.

Figure 20:
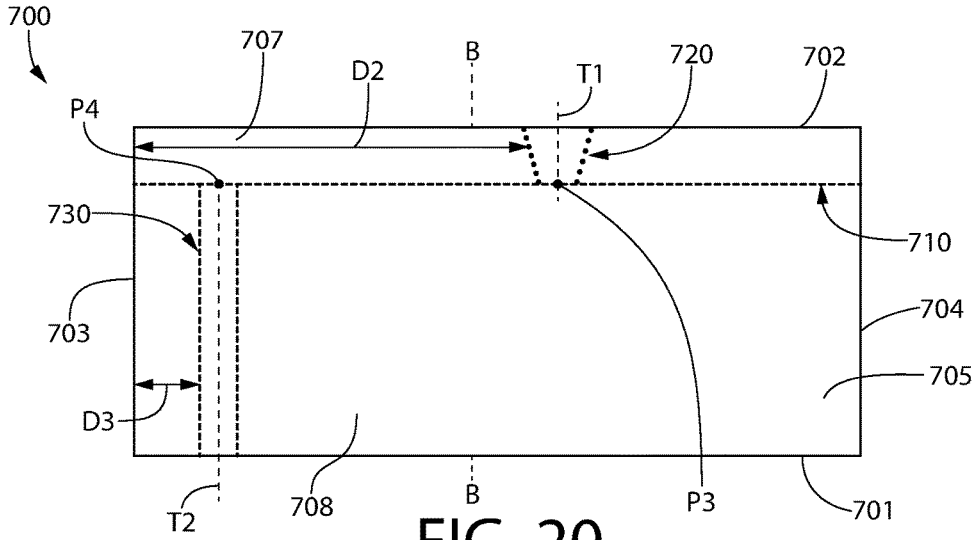
FIG. 20 is a front view of a blank of the sleeve of the container apparatus of FIG. 1B.
Figure 21:
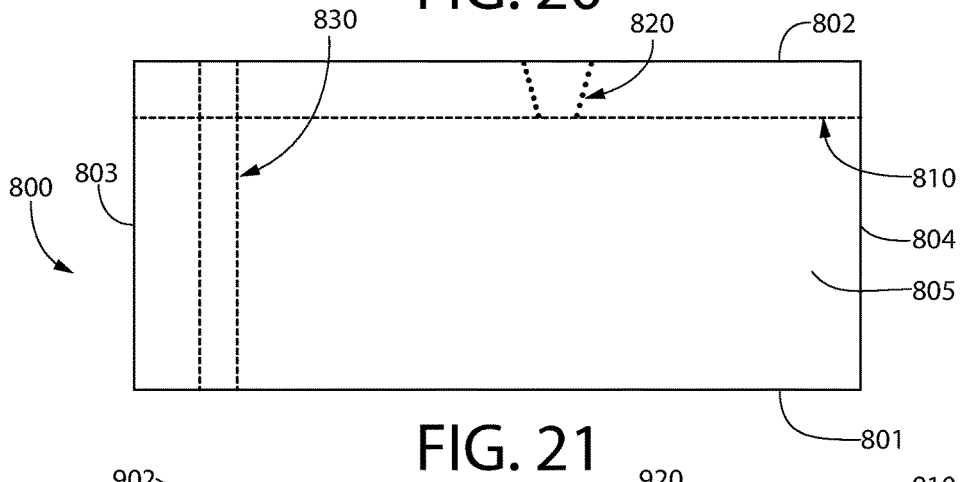
FIG. 21 is a front view of a blank of the sleeve of the container apparatus of FIG. 14.
Figure 22:
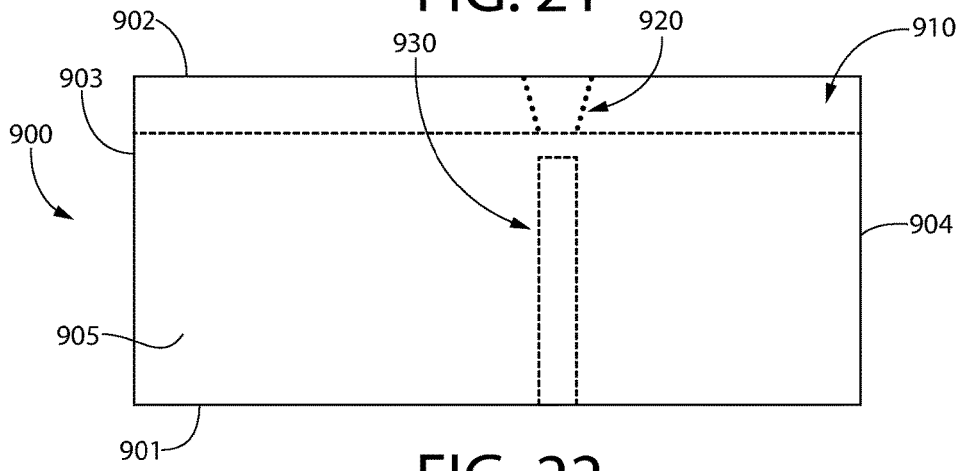
FIG. 22 is a front view of a blank of the sleeve of the container apparatus of FIG. 18.

Turning now to FIGS. 20-22, blanks 700, 800, 900 that are used to form the sleeves 200, 400, 600, respectively will be described. The blank 700 is used to form the sleeve 200, the blank 800 is used to form the sleeve 400, and the blank 900 is used to form the sleeve 600. Similar numbering will be used to describe similar features in the blanks 700, 800, 900 and the sleeves 200, 400, 600 except that the 700-, 800-, and 900-series of numbers will be used. Thus, for features that are denoted in the drawings but not described, the description of that similar feature with reference to the sleeve 200, 400, 600 is applicable.

Referring first to FIG. 20, the blank 700 that is used to form the sleeve 200 will be described. The blank 700 comprises a sheet of material 705 formed of a polymer plastic film such as those described above. The sheet of material extends from a bottom edge 701 to a top edge 702 along an axis B-B. The sheet of material also has a first side edge 703 and a second side edge 704 that oppose one another and extend between the top and bottom edges 701, 702. The blank 700 has a first pre-weakened section 710, a second pre-weakened section 720, and a third pre-weakened section 730 that are similar to the similarly named features on the sleeve 200. The details of the structure of each of the first, second, and third pre-weakened sections 710, 720, 730 has previously been described with regard to the sleeve 200 and that description is applicable.

The first pre-weakened section 710 extends between the first and second side edges 703, 704 of the sheet of material 705 and divides the sheet of material 705 into a first or upper portion 707 and a second or lower portion 708. The second pre-weakened section 720 extends between the top edge 702 of the sheet of material 705 and the first pre-weakened section 710. In the exemplified embodiment, the second pre-weakened section 720 extends from the top edge 702 to the first pre-weakened section 710, although in other embodiments it may be spaced from one or both of the top edge 702 and the first pre-weakened section 710. Regardless, in the exemplified embodiment the second pre-weakened section 720 is located entirely within the first portion 707 of the sheet of material 705. The third pre-weakened section 730 extends between the bottom edge 701 of the sheet of material 705 and the first pre-weakened section 710. In the exemplified embodiment, the third pre-weakened section 730 extends from the bottom edge 701 to the first pre-weakened section 710, although in other embodiments it may be spaced from one or both of the bottom edge 701 and the first pre-weakened section 710. Regardless, in the exemplified embodiment the third pre-weakened section 730 is located entirely within the second portion 708 of the sheet of material 705.

In this embodiment, the second pre-weakened section 720 is transversely spaced apart from the third pre-weakened section 730. Stated another way, the second and third pre-weakened sections 720, 730 are not axially aligned with one another. Rather, the second pre-weakened section 720 is spaced apart from the first side edge 703 of the sheet of material 705 by a distance D2 and the third pre-weakened section 730 is spaced apart from the first side edge 703 of the sheet of material 705 by a distance D3, the distance D3 being greater than the distance D2.

In the exemplified embodiment, there is no axis parallel to the axis B-B of the sheet of material 705 that intersects a portion of the second pre-weakened section 720 and a portion of the third pre-weakened section 730. However, the invention is not to be so limited in all embodiments. In some embodiments, one or both of the second and third pre-weakened sections 720, 730 may extend diagonally along the sheet of material 705 rather than being vertical and parallel to the axis B-B as with the exemplified embodiment.

In such an embodiment, it is possible that an axis parallel to the axis B-B may intersect both the second and third pre-weakened sections 720, 730. However, in such an embodiment the second pre-weakened section 720 delineates a reference tear line T1 that intersects the first pre-weakened line 710 at a point P3 and the third pre-weakened line 730 delineates a reference tear line T2 that intersects the first pre-weakened line 710 at a point P4, the points P3 and P4 being transversely spaced apart from one another. Stated another way, the second ends 724, 734 of the second and third pre-weakened lines 720, 730 may be spaced apart in a direction transverse to the axis B-B of the sheet of material 705.

Referring to FIG. 21, the blank 800 will be described, which is the blank used to form the sleeve 400 of FIGS. 14-17. The blank 800 comprises a sheet of material 805 that comprises a bottom edge 801, a top edge 802, a first side edge 803, and a second side edge 804. The sheet of material 805 comprises a first pre-weakened section 810, a second pre-weakened section 820, and a third pre-weakened section 830. The blank 800 is identical to the blank 700 except that the third pre-weakened section 830 extends the entire height of the sheet of material 805 from the bottom end 801 to the top end 802.

Referring to FIG. 22, the blank 900 will be described, which is the blank used to form the sleeve 600 of FIGS. 18-19A. The blank 900 comprises a sheet of material 905 that comprises a bottom edge 901, a top edge 902, a first side edge 903, and a second side edge 904. The sheet of material 905 comprises a first pre-weakened section 910, a second pre-weakened section 920, and a third pre-weakened section 930. The blank 900 is identical to the blank 700 except that: (1) the second and third pre-weakened sections 920, 930 are axially aligned along an axis that is parallel to the axis of the sheet of material 905 extending between the bottom end top edges 901, 902 thereof; and (2) the third pre-weakened section 930 is spaced from rather than extending all the way to the first pre-weakened section 910. The description of these concepts with regard to the sleeve 600 is applicable and will not be repeated here in the interest of brevity.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A container apparatus comprising:

a container extending along an axis, the container comprising:

a body having a cavity for containing a material; and a cap coupled to the body;

a sleeve circumscribing at least a portion of the container and extending from a bottom edge to a top edge, the sleeve having a first pre-weakened section that divides the sleeve into a first portion and a second portion, the first portion of the sleeve comprising a second pre-weakened section and the second portion of the sleeve comprising a third pre-weakened section, the second and third pre-weakened sections being circumferentially aligned;

wherein the third pre-weakened section comprises an alternating arrangement of perforated segments and non-perforated segments, the non-perforated segments having a maximum length; and wherein the third pre-weakened section extends from the bottom edge of the sleeve to a location that is spaced an axial distance from the first pre-weakened section of the sleeve, the axial distance being greater than the maximum length.

2. The container apparatus according to claim 1 wherein the third pre-weakened section comprises a pair of spaced apart pre-weakened lines and a removable strip between the pair of spaced apart pre-weakened lines, and further comprising indicia on the removable strip; wherein the indicia comprises instructions for tearing away the removable strip to separate the second portion of the sleeve from the container; and wherein the indicia is located on the removable strip along a bottom one-fifth of a height of the container measured between the bottom and top ends of the container.

3. The container apparatus according to claim 1 wherein tearing along the second pre-weakened section and the first pre-weakened section detaches the first portion of the sleeve from the second portion of the sleeve and separates the first portion of the sleeve from the container while the second portion of the sleeve remains coupled to the container, and wherein subsequently tearing along the third pre-weakened section detaches the second portion of the sleeve from the container.

4. The container apparatus according to claim 1 wherein the second pre-weakened section extends from the top edge of the sleeve to the first pre-weakened section.

5. The container apparatus according to claim 1 wherein the first pre-weakened section circumscribes the container.

6. A container apparatus comprising:

a container extending along an axis, the container comprising:

a body having a cavity for containing a material; and a cap coupled to the body;

a sleeve circumscribing at least a portion of the container, the sleeve having a first pre-weakened section that divides the sleeve into a first portion and a second portion, the first portion comprising a second pre-weakened section and the second portion comprising a third pre-weakened section, the second and third pre-weakened sections being circumferentially aligned; and wherein the first pre-weakened section has a first tear strength, the second pre-weakened section has a second tear strength, and the third pre-weakened section has a third tear strength, the second and third tear strengths being greater than the first tear strength.

7. The container apparatus according to claim 6 wherein the second tear strength is greater than the third tear strength.

8. The container apparatus according to claim 6 wherein the third tear strength is greater than the second tear strength.

9. The container apparatus according to claim 6 wherein the sleeve extends from a top edge to a bottom edge, the second pre-weakened section extending from the top edge of the sleeve to the first pre-weakened section.

10. The container apparatus according to claim 9 wherein the third pre-weakened section extends from the bottom edge of the sleeve to the first pre-weakened section.

11. The container apparatus according to claim 9 wherein the third pre-weakened section extends from the bottom edge of the sleeve to the top edge of the sleeve.

12. The container apparatus according to claim 9 wherein the third pre-weakened section extends from the bottom edge of the sleeve to a location of the sleeve that is adjacent to but axially spaced apart from the first pre-weakened section.

13. The container apparatus according to claim 6 wherein each of the first, second, and third pre-weakened sections comprise perforations formed into the sleeve.

14. The container apparatus according to claim 6 wherein the first pre-weakened section is a single pre-weakened line circumscribing the container, the second pre-weakened section comprises a first pair of spaced apart pre-weakened lines and a first removable strip therebetween, and the third pre-weakened section comprises a second pair of spaced apart pre-weakened lines and a second removable strip therebetween.

* * * * *